US010450134B2

(12) United States Patent
Boyea

(10) Patent No.: US 10,450,134 B2
(45) Date of Patent: Oct. 22, 2019

(54) EXTENDER FOR RECEPTACLE AND METHOD THEREOF

(71) Applicant: Christopher E. Boyea, Burnt Hills, NY (US)

(72) Inventor: Christopher E. Boyea, Burnt Hills, NY (US)

( * ) Notice: Subject to any disclaimer, the term of this patent is extended or adjusted under 35 U.S.C. 154(b) by 0 days.

(21) Appl. No.: 15/982,807

(22) Filed: May 17, 2018

(65) Prior Publication Data

US 2018/0265285 A1 Sep. 20, 2018

Related U.S. Application Data

(63) Continuation-in-part of application No. 15/831,600, filed on Dec. 5, 2017, which is a continuation of (Continued)

(51) Int. Cl.
*B65D 6/16* (2006.01)
*B65F 1/10* (2006.01)

(Continued)

(52) U.S. Cl.
CPC ..... *B65F 1/10* (2013.01); *B65F 1/04* (2013.01); *B65F 1/1473* (2013.01)

(58) Field of Classification Search
CPC . B65F 1/10; B65F 1/04; B65F 1/1473; B65D 21/083

(Continued)

(56) References Cited

U.S. PATENT DOCUMENTS 1,238,090 A 8/1917 Beringer
1,666,294 A * 4/1928 Downes-Martin ..... A24F 19/12 131/240.1

(Continued)

FOREIGN PATENT DOCUMENTS

JP 2012140217 7/2012
JP 2012140217 A * 7/2012

(Continued)

OTHER PUBLICATIONS

Non-Final Office Action for U.S. Appl. No. 15/672,503, dated Aug. 25, 2017.

(Continued)

*Primary Examiner* — J. Gregory Pickett
*Assistant Examiner* — Niki M Eloshway
(74) *Attorney, Agent, or Firm* — Schmeiser, Olsen & Watts, LLP

(57) ABSTRACT

An extender formed from at least one flat piece of material that has straight edges, that includes a body structure formed by attaching a first edge of the at least one flat piece of material to a second, opposing edge thereof. The body structure includes a wall defining an interior space extending therethrough and at least one dynamic portion configured to be manipulated to create a first fold portion and a second fold portion that inwardly extend into the interior space. The body structure is configured to be inserted into a garbage can to extend a capacity of the garbage can. As the body structure is further inserted into the garbage can, the at least one dynamic portion facilitates a change in shape of the wall so that at least a portion of the wall becomes more tapered the further the body structure is inserted into the garbage can.

17 Claims, 30 Drawing Sheets

Related U.S. Application Data application No. 15/672,503, filed on Aug. 9, 2017, which is a continuation of application No. 14/818,175, filed on Aug. 4, 2015, now Pat. No. 9,783,362.

(60) Provisional application No. 62/032,875, filed on Aug. 4, 2014.

(51) Int. Cl.
*B65F 1/04* (2006.01)
*B65D 6/02* (2006.01)
*B65F 1/14* (2006.01)

(58) Field of Classification Search
USPC ..... 220/720, 4.03, 4.26, 495.11, 908.3; 229/101; 206/501, 508
See application file for complete search history.

(56) References Cited

U.S. PATENT DOCUMENTS

| | | | | |
|---|---|---|---|---|
| 1,724,743 | A | 8/1929 | Allen | |
| 1,858,793 | A | 5/1932 | Reynolds | |
| 2,107,995 | A | 2/1938 | Statham | |
| 2,429,958 | A | 10/1947 | Liebmann | |
| 2,572,610 | A * | 10/1951 | Gilbert | B65D 5/029 229/112 |
| 2,924,377 | A | 2/1960 | Lewis | |
| 3,119,494 | A * | 1/1964 | Rosenstiel | B65D 5/0005 206/216 |
| 3,525,962 | A | 8/1970 | Javorik | |
| 3,539,091 | A * | 11/1970 | Murray | B65D 5/5009 206/418 |
| 4,161,252 | A | 7/1979 | Howells | |
| 4,280,676 | A | 7/1981 | Betts | |
| 4,628,007 | A | 12/1986 | Ledsham | |
| 4,852,757 | A | 8/1989 | Milton | |
| 4,860,910 | A | 8/1989 | Zipper | |
| 4,940,138 | A | 7/1990 | Hornstein | |
| 4,974,737 | A | 12/1990 | Miller | |
| 4,976,737 | A | 12/1990 | Leake | |
| 4,979,547 | A | 12/1990 | Hoerner | |
| 5,035,563 | A | 1/1991 | Armand | |
| 5,022,548 | A | 6/1991 | Stakis | |
| D318,163 | S | 7/1991 | Chalmers | |
| D318,896 | S | 8/1991 | Starkweather | |
| 5,048,778 | A | 9/1991 | Wright | |
| 5,271,589 | A | 12/1993 | Belous | |
| 5,417,338 | A | 5/1995 | Roy et al. | |
| 5,445,397 | A | 8/1995 | Evans | |
| 5,598,942 | A | 2/1997 | Cowie | |
| 5,642,828 | A | 7/1997 | Sorens | |
| 5,765,614 | A | 6/1998 | Kardosh et al. | |
| 5,897,084 | A | 4/1999 | Judge | |
| 5,915,768 | A * | 6/1999 | Young | B65B 67/12 15/257.1 |
| 6,062,415 | A | 5/2000 | Harper | |
| 6,131,759 | A | 10/2000 | Young | |
| 6,135,518 | A | 10/2000 | Holthaus | |
| 6,581,796 | B1 | 6/2003 | Pilkinton | |
| 6,938,860 | B2 | 9/2005 | Singleton | |
| 7,077,283 | B2 | 7/2006 | Yang et al. | |
| 7,192,037 | B1 | 3/2007 | Pena | |
| 7,219,705 | B2 | 5/2007 | Wallek | |
| 7,302,978 | B1 | 12/2007 | Kolarik | |
| 7,562,784 | B2 | 7/2009 | Stevenson | |
| 7,789,238 | B2 | 9/2010 | Claypool | |
| 7,866,538 | B2 * | 1/2011 | Liao | B65D 5/0005 229/101 |
| D633,268 | S | 2/2011 | Bottita | |
| 7,886,926 | B2 | 2/2011 | Orgeldinger | |
| 7,984,733 | B2 | 7/2011 | Noonan | |
| 8,479,780 | B2 | 7/2013 | Fernandez et al. | |
| 8,757,563 | B2 | 6/2014 | Muse | |
| 9,771,184 | B2 * | 9/2017 | Arcot | B65D 33/007 |
| 9,783,362 | B2 | 10/2017 | Boyea | |
| 2004/0089657 | A1 | 5/2004 | Waszak | |
| 2006/0144467 | A1 | 7/2006 | Butzer | |
| 2007/0158345 | A1 | 7/2007 | Booth et al. | |
| 2008/0029658 | A1 * | 2/2008 | Vanbost | B65B 67/04 248/99 |
| 2008/0251526 | A1 | 10/2008 | Fick | |
| 2010/0089916 | A1 | 4/2010 | Fielden | |
| 2010/0108826 | A1 | 5/2010 | Fernandez | |
| 2011/0309209 | A1 | 12/2011 | Muse | |
| 2012/0012228 | A1 | 1/2012 | Karabas | |
| 2012/0248118 | A1 * | 10/2012 | Perkowski | B65B 67/1205 220/495.08 |
| 2015/0014310 | A1 | 1/2015 | Liu et al. | |
| 2015/0069054 | A1 | 3/2015 | Nolan et al. | |
| 2015/0375558 | A1 | 12/2015 | Ben-Or | |
| 2016/0031641 | A1 | 2/2016 | Boyea | |
| 2016/0145041 | A1 | 5/2016 | Fritch | |
| 2017/0210558 | A1 | 7/2017 | Boyea | |
| 2017/0341859 | A1 | 11/2017 | Boyea | |
| 2018/0086492 | A1 * | 3/2018 | Weathers | B65F 1/10 |
| 2018/0093826 | A1 | 4/2018 | Boyea | |

FOREIGN PATENT DOCUMENTS

| | | | |
|---|---|---|---|
| KR | 2013000959 | U | 2/2013 |
| KR | 2020110006981 | | 2/2013 |
| WO | 2013150307 | A1 | 10/2013 |

OTHER PUBLICATIONS

Non-Final Office Action for U.S. Appl. No. 14/818,175, dated Jan. 12, 2016.
Final Office Action for U.S. Appl. No. 14/818,175, dated Sep. 14, 2016.
Advisory Action for U.S. Appl. No. 14/818,175, dated Jan. 10, 2017.
Non-Final Office Action for U.S. Appl. No. 14/818,175, dated Mar. 13, 2017.
Notice of Allowance for U.S. Appl. No. 14/818,175, dated Jun. 16, 2017.
Issue Notice for U.S. Appl. No. 14/818,175, dated Sep. 20, 2017.
Non-Final Office Action for U.S. Appl. No. 15/831,600, dated Jan. 26, 2018.
Office Action (dated Jan. 11, 2018) for U.S. Appl. No. 15/480,723, filed Apr. 6, 2017.
Office Action (dated Jun. 6, 2017) for U.S. Appl. No. 15/480,723, filed Apr. 6, 2017.
Office Action (dated Jun. 6, 2018) for U.S. Appl. No. 15/672,503, filed Aug. 9, 2017.
Office Action (dated Feb. 8, 2019) for U.S. Appl. No. 15/672,503, filed Aug. 9, 2017.
Office Action (dated Sep. 7, 2018) for U.S. Appl. No. 15/831,600), filed Dec. 5, 2017.
Office Action (dated Dec. 13, 2018) for U.S. Appl. No. 15/831,600), filed Dec. 5, 2017.

* cited by examiner providing a receptacle for storing waste materials, the receptacle configured to be lifted and inverted by a mechanical means of a garbage collection vehicle to empty the waste materials providing an extender for use with the receptacle, the extender cooperating with the receptacle to increase a storage capacity of the provided receptacle, wherein the extender is disposable along with the waste materials at the same time, collecting the waste materials and the extender using the mechanical means of the garbage collection means

FIG. 20

EXTENDER FOR RECEPTACLE AND METHOD THEREOF

CROSS-REFERENCE TO RELATED APPLICATIONS

This application is a continuation-in-part application that claims priority to and the benefit of U.S. application Ser. No. 15/831,600, filed Dec. 5, 2017, entitled "Extender for Receptacle and Method Thereof," which is a continuation of U.S. application Ser. No. 15/672,503, filed Aug. 9, 2017, entitled "Extender for Receptacle and Method Thereof," which is a continuation application that claims priority to and the benefit of U.S. application Ser. No. 14/818,175, filed Aug. 4, 2015, and entitled "Extender For a Receptacle and Method Thereof," which claims priority to Provisional Application No. 62/032,875, having a filing date of Aug. 4, 2014, the entire contents of which are hereby incorporated by reference.

FIELD OF TECHNOLOGY

The following relates to waste management disposal and containment, and more specifically to embodiments of a device that can increase the capacity of a standard receptacle, while also making garbage collection more efficient.

BACKGROUND

Receptacles, such as garbage cans, typically come in standard sizes. In some households, the standard capacity of the garbage is exceeded before the garbage pickup is scheduled to come. This is especially true when a household hosts a party or an event that results in a larger than normal amount of garbage. The current solution is to stack the garbage next to the garbage can, or purchase an additional garbage can. Stacking the garbage next to the garbage perpetuates an odorous environment, is aesthetically unappealing, and adds labor time for the garbage collectors. Purchasing an additional garbage takes up extra space, can lead to additional charges from a garbage collection company, and may not be compatible with automated garbage trucks.

Thus, a need exists for an apparatus and method for increasing a capacity of a receptacle, storing an additional amount of garbage, and a method of disposal.

SUMMARY

A first aspect relates generally to an extender, the extender formed from at least one flat piece of material that has straight edges, comprising a body structure, the body structure formed by attaching a first edge of the at least one flat piece of material to a second, opposing edge of the at least one flat piece of material, wherein the body structure includes a wall defining an interior space extending through the body structure; and at least one dynamic portion of the body structure, wherein the at least one dynamic portion is configured to be manipulated to create a first fold portion and a second fold portion that inwardly extends into the interior space; wherein the body structure is configured to be inserted into a garbage can to extend a capacity of the garbage can, and as the body structure is further inserted into the garbage can, the at least one dynamic portion facilitates a change in shape of the wall so that at least a portion of the wall becomes more tapered the further the body structure is inserted into the garbage can.

A second aspect relates generally to an extender comprising at least one piece of material having a first edge and a second edge; wherein the first edge and the second edge are attached to create an interior space extending through the extender; a top edge; a bottom edge; a point located between the top edge and the bottom edge; an upper portion of the extender extending between the top edge and the point; a lower portion of the extender extending between the point and the bottom edge; and a fold, comprising a first fold portion and a second fold portion; wherein the fold is configured to extend inwards towards the interior space, wherein the fold extends from the point to the bottom edge, wherein the fold is configured to taper the extender from the point to the bottom edge.

A third aspect relates generally to a method for manufacturing an extender, the method comprising: pre-forming at least one dynamic portion in at least one flat piece of material, the at least one flat piece of material comprising an upper portion and a lower portion, wherein the pre-forming comprises creating a vertical guide line within the lower portion, such that the at least one dynamic portion can be manipulated by a user.

A fourth aspect relates generally to a method for collecting waste, the method comprising providing a receptacle for storing waste materials, the receptacle configured to be lifted and inverted by a mechanical means of a garbage collection vehicle to empty the waste materials; providing an extender for use with the receptacle, the extender cooperating with the receptacle to increase a storage capacity of the provided receptacle, wherein the extender is disposable along with the waste materials; and at the same time, collecting the waste materials and the extender using the mechanical means of the garbage collection means; wherein the extender is formed from at least one flat piece of material that has straight edges and at least one dynamic portion of the body structure, wherein the at least one dynamic portion is configured to be manipulated to create a first fold portion and a second fold portion that inwardly extends into the interior space; wherein the extender is configured to receive waste materials through the interior space.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein:

FIG. 20 depicts a flowchart of an embodiment of a method;

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
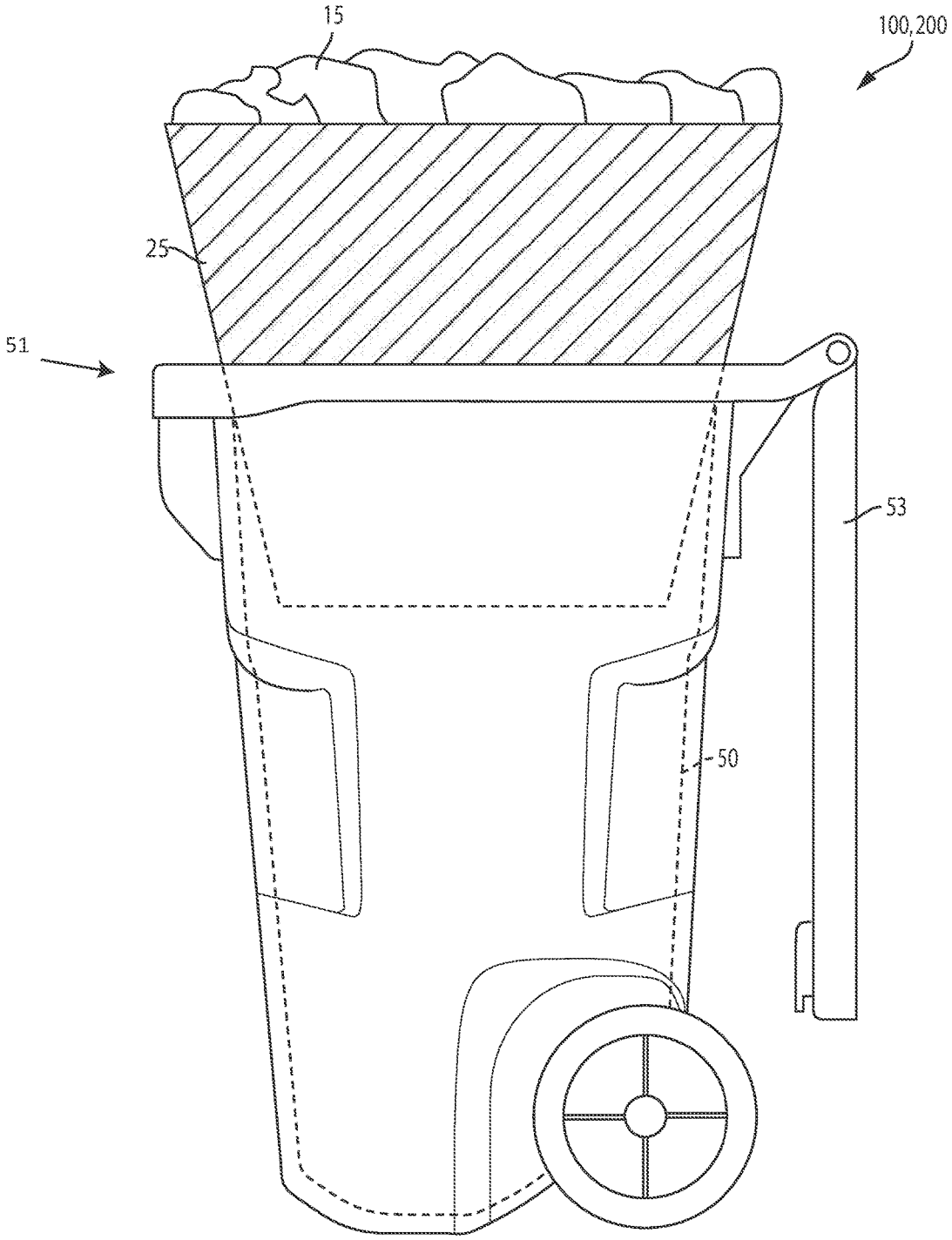
FIG. 1 depicts a schematic view of a first embodiment of an extender located within an embodiment of a receptacle.

Referring to the drawings, FIG. 1 depicts an embodiment of an extender 100, 200 operably engaged with a receptacle 50. The extender 100, 200 may be a device that may be configured to be placed at least partially within a receptacle 50, such as industry standard sized garbage can, to extend or otherwise increase a capacity of the receptacle 50. The increased capacity, labeled as increased capacity 25 in FIG. 1, is an amount of volume for storing garbage, waste, yard waste, leaves, etc., or any contents suitable for placement in a receptacle that is in addition to a maximum volume afforded by the receptacle 50. For example, if the receptacle 50 becomes full of waste materials 15, such as garbage, waste, recyclables, yard waste, and the like, any additional waste materials will not fit properly within the receptacle 50, and likely fall to the side of the receptacle 50, or can blow away due to the wind or other environmental elements. To increase a volume or storage capacity of the receptacle 50, embodiments of an extender 100, 200 may be placed at least partially within the receptacle 50 so that additional waste materials 15 may be added to the waste material already within the receptacle 50. While the extender 100, 200 is operatively attached to the receptacle 50, a storage capacity of the receptacle 50 is effectively increased because of the walls of the extender 100 extending beyond a top end 51 of the receptacle 50. Embodiments of the receptacle 50 may be a garbage can, a pail, a garbage pail, a transportable waste container, a waste collection device, a barrel, a bucket, and the like. Embodiments of the receptacle 50 may be an industrial garbage can, and may be compatible with automatic garbage truck loaders, for example, receptacles provided by waste collection companies for scheduled pickup. In some embodiments, the receptacle 50 may include a cover 53 that can be hingedly or otherwise pivotally attached to the receptacle 50. Further, embodiments of receptacle 50 may be various sizes, as might be offered/provided by a waste collection company or a municipality, or otherwise available for purchase at a home improvement store.

Figure 2:
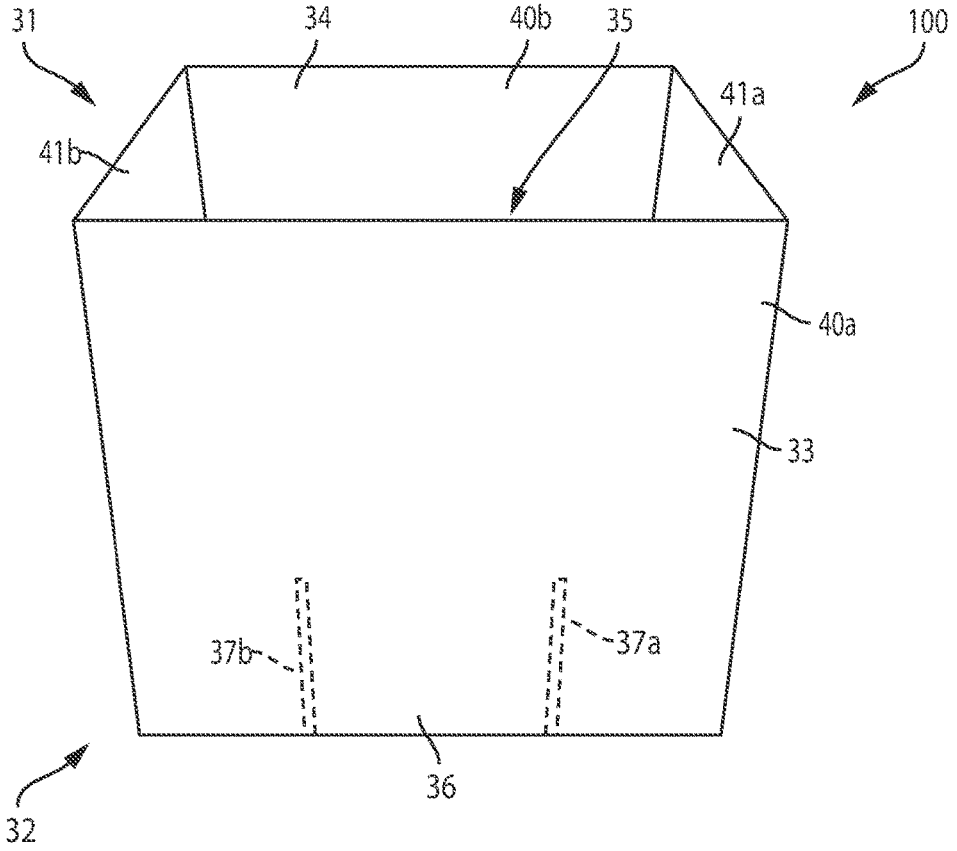
FIG. 2 depicts a perspective view of the first embodiment of an extender.

With continued reference to FIG. 1, an embodiment of extender 100 is depicted in FIG. 2. Embodiments of extender 100 may be an insert, a tapered box, a tapered structure, a garbage containment unit, a cardboard insert, or the like, sized and dimensioned to be placed within a receptacle 50 of various sizes. Embodiments of extender 100 may include a first end 31, a second end 32, an outer surface 33, an inner surface 34, and a general opening extending therethrough. Embodiments of extender 100 may be cone-shaped, and may be comprised of a single wall. Embodiments of the extender 100 may be tapered. For instance, embodiments of the extender 100 may taper in a direction from the first end 31 toward a second end 32, such that a width of the extender 100 may gradually decrease from the first end 31 to the second end 32. A tapered structure or configuration of the extender 100 may ensure or promote a friction fit with the receptacle 50 as the extender 100 is lowered or otherwise placed within an interior of the receptacle 50. The tapered configuration may also accommodate various sizes of an interior of various receptacles 50. Further embodiments of the extender 100 may include a tapered section proximate or otherwise near the second end 32, wherein a portion of the extender 100 (e.g. proximate or otherwise near the first end 31) is not tapered, and only begins to taper at a point proximate or otherwise near the second end 32.

Moreover, embodiments of the extender 100 may include a plurality of walls 40*a*, 40*b*, 41*a*, 41*b*. The plurality of walls 40*a*, 40*b*, 41*a*, 41*b* may form or otherwise define an interior space 35 of the extender 100. Each of the plurality of walls 40*a*, 40*b*, 41*a*, 41*b* may be shaped like a trapezoid to facilitate the tapered shape/configuration of the extender 100. A number and an arrangement of the plurality of walls, when operably configured, may correspond to a geometric shape of an opening of the receptacle 50 so that it may at least partially fit within the receptacle 50. In one embodiment, the extender 100 may include four walls, with a front wall 40*a*, a back wall 40*b*, a first side wall 41*a*, and a second side wall 41*b*. The walls 40*a*, 40*b*, 41*a*, 41*b* may be equal in size, or may vary in size with respect to each other. Furthermore, the walls 40*a*, 40*b*, 41*a*, 41*b* may be structurally integral with each other and joined along each edge to the next wall, as shown in FIG. 2. The edges may be creased or pre-creased to facilitate or promote flexibility of the extender 100. The flexibility of the extender 100 may vary, but in some cases, the extender 100 may be able to be folded into a flat unit, while all of the edges of the walls 40*a*, 40*b*, 41, 41*b* remain connected, structurally integral or otherwise.

Figure 3:
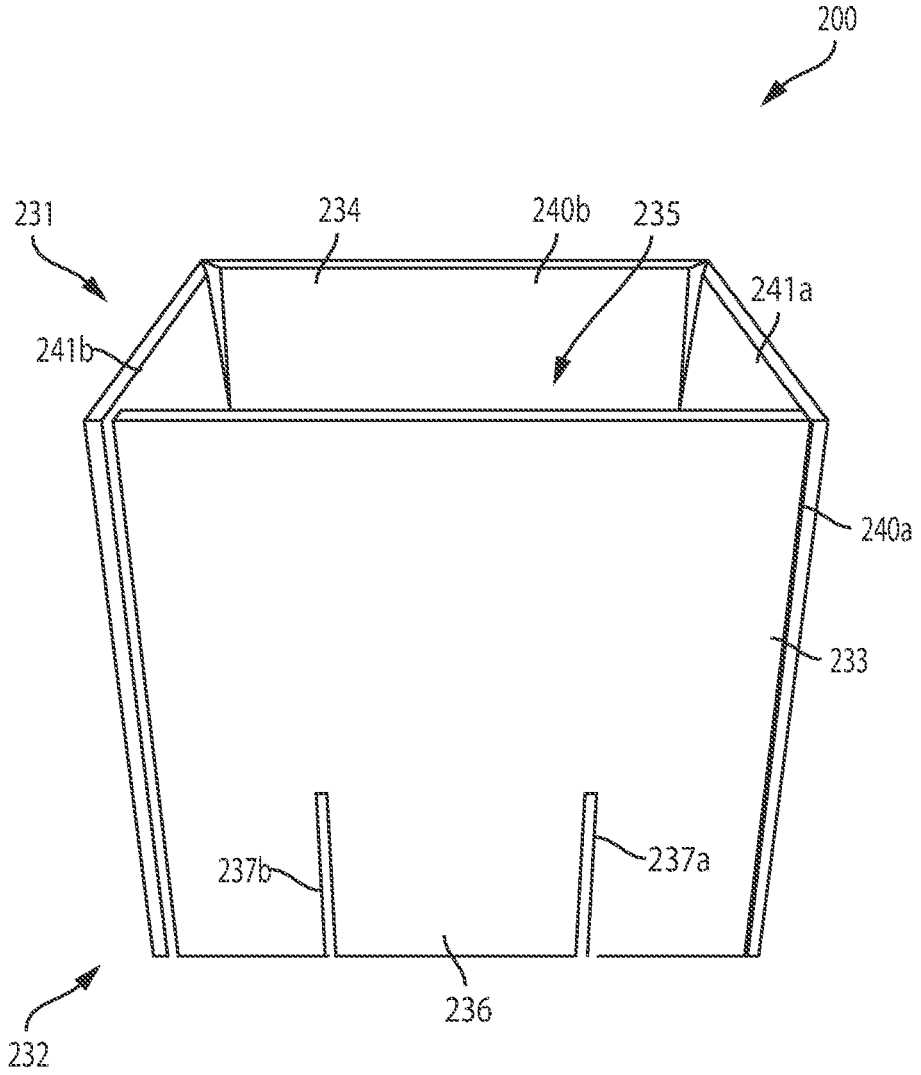
FIG. 3 depicts a perspective view of a second embodiment of an extender.
Figure 4:
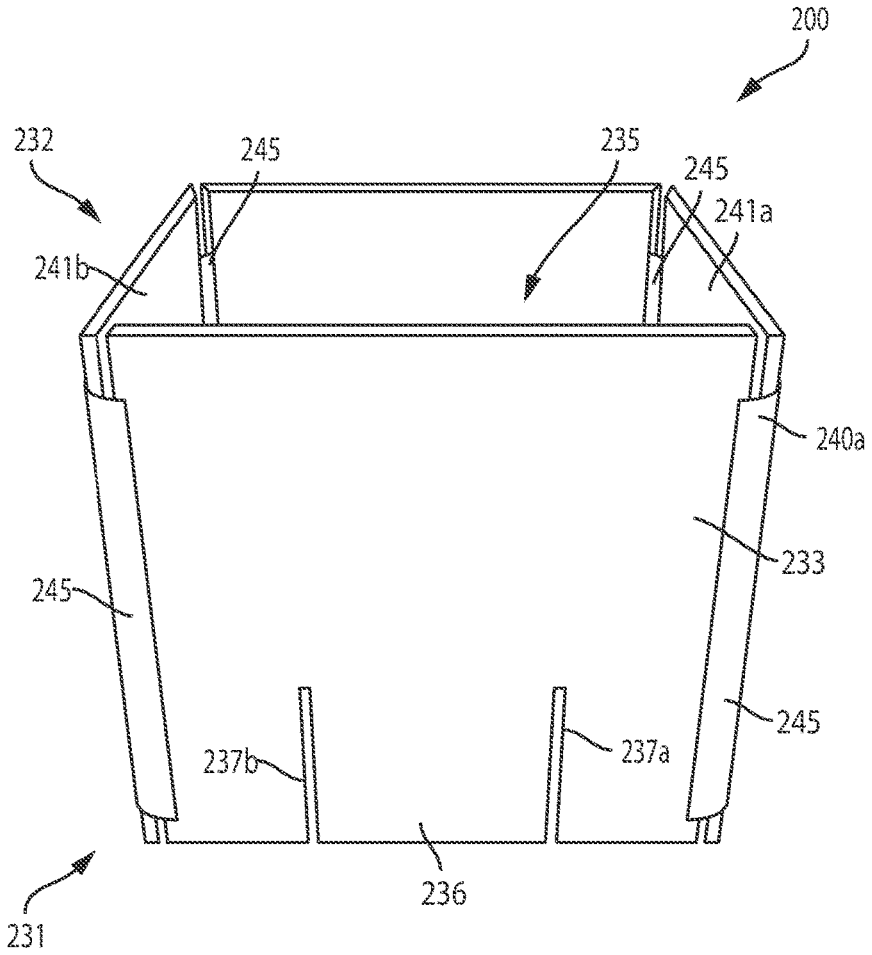
FIG. 4 depicts a perspective view of the second embodiment of an extender with an embodiment of a connection element.

FIG. 3 depicts an embodiment of extender 200. Embodiments of extender 200 may share the same or substantially the same structural and functional aspects of extender 100, including a first end 231, a second end 232, an outer surface 233, and inner surface 234, a general opening therethrough, and an interior space 235. However, extender 200 may include at least one edge of one of the plurality of walls 240*a*, 240*b*, 241*a*, 241*b* may be a free edge, which may also allow the extender 200 to be packaged and sold as a flat, or relatively flat, or a folded flat unit. For example, a left edge of front wall 240*a* may be a free edge, while the other, right, edge of the front wall 240*a* is connected to the left edge of first side wall 241*a*. In this example, an edge of the second side wall 41*b* may also be a free edge. Any configuration or combination of free edges may be implemented to form extender 200. In some operable configurations, such as shown in FIG. 4, the free edges may be connected to each other for added stability once ready for use. For instance, the free edges may be connected to each other using a connection element 245. Embodiments of connection element 245 may be an adhesive tape, such as duct tape, staples, glue, clap, or other suitable material or component that may join two edges of the walls 240*a*, 240*b*, 241*a*, 241*b* together. In other operable configurations, the free edges may remain unconnected when placed within the receptacle 50, wherein the free edges are proximate or otherwise near each other when in this operable configuration.

With continued reference to FIGS. 2-4, embodiments of extender 100, 200 may also include a deflection flap 36, 236. Embodiments of deflection flap 36, 236 may be a section of the extender 100, 200 of one or more walls of extender 100, 200 that may deflect inward or outward to accommodate various sizes of receptacle 50. The deflection, inward or outward, may further promote or otherwise ensure a friction fit between an inner surface of the receptacle 50 and the extender 100, 200. For example, receptacle 50 may have various interior shapes (e.g. protrusions, etc.) that may engage portions of the extender 100, 200 with a different force than another area of the extender 100, 200. The deflection flap or deflection portion 36, 236 may deflect or otherwise move inwardly or outwardly to increase a mechanical interference or friction fit between the receptacle 50 and the extender 100, 200 to compensate for looser connections between the receptacle 50 and the extender 100, 200 in other areas. The deflection of the flap 36, 236 may also be affected by waste materials already within receptacle 50, which may also promote friction fit between the extender 100, 200 and the receptacle 50. Embodiments of the deflection flap 36, 236 may be formed by one or more vertical slits 237*a*, 237*b* extending from a second end 32, 232 of the extender 100, 200 a distance towards the first end 32, 232. The vertical slits may permit deflection inwardly or outwardly, as described above. The vertical slits 237*a*, 237*b* may be perforations, or may be a continuous cut into the extender 100, 200. Furthermore, embodiments of the extender 100, 200 may be made out of cardboard or other suitable material. The material(s) forming the extender 100, 200 may be disposable. However, in some embodiments, the extender 100, 200 may be made of a material that can be reused without significant risk of damage if exposed to environmental elements. In further embodiments, the extender 100, 200 may be made out a metal, such as aluminum, or plastic and can be recycled with the other contents within the receptacle 50, such as known recyclable items that are commonly discarded.

Figure 5:
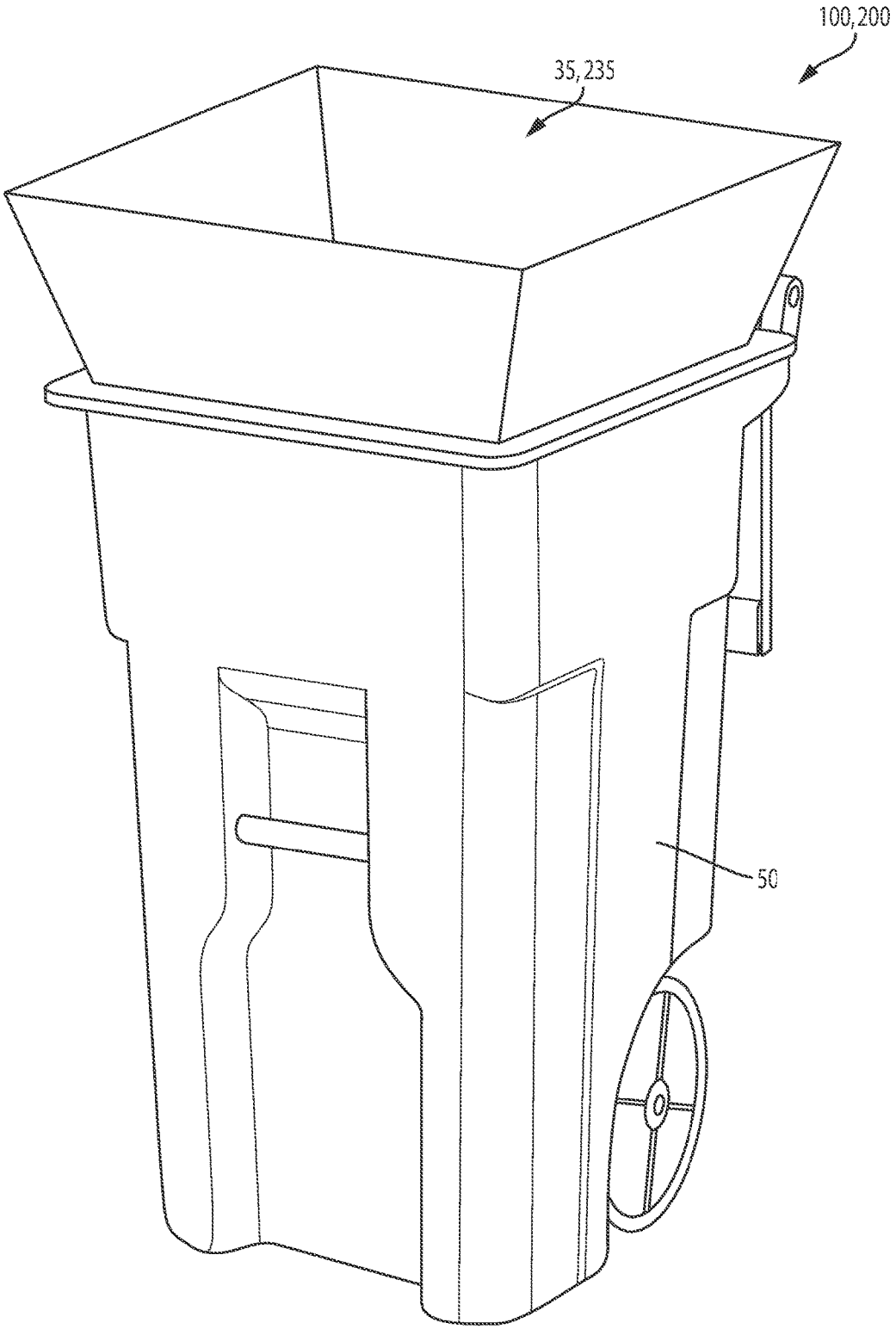
FIG. 5 depicts a perspective view of an embodiment of an extender operably configured with an embodiment of a receptacle.
Figure 6:
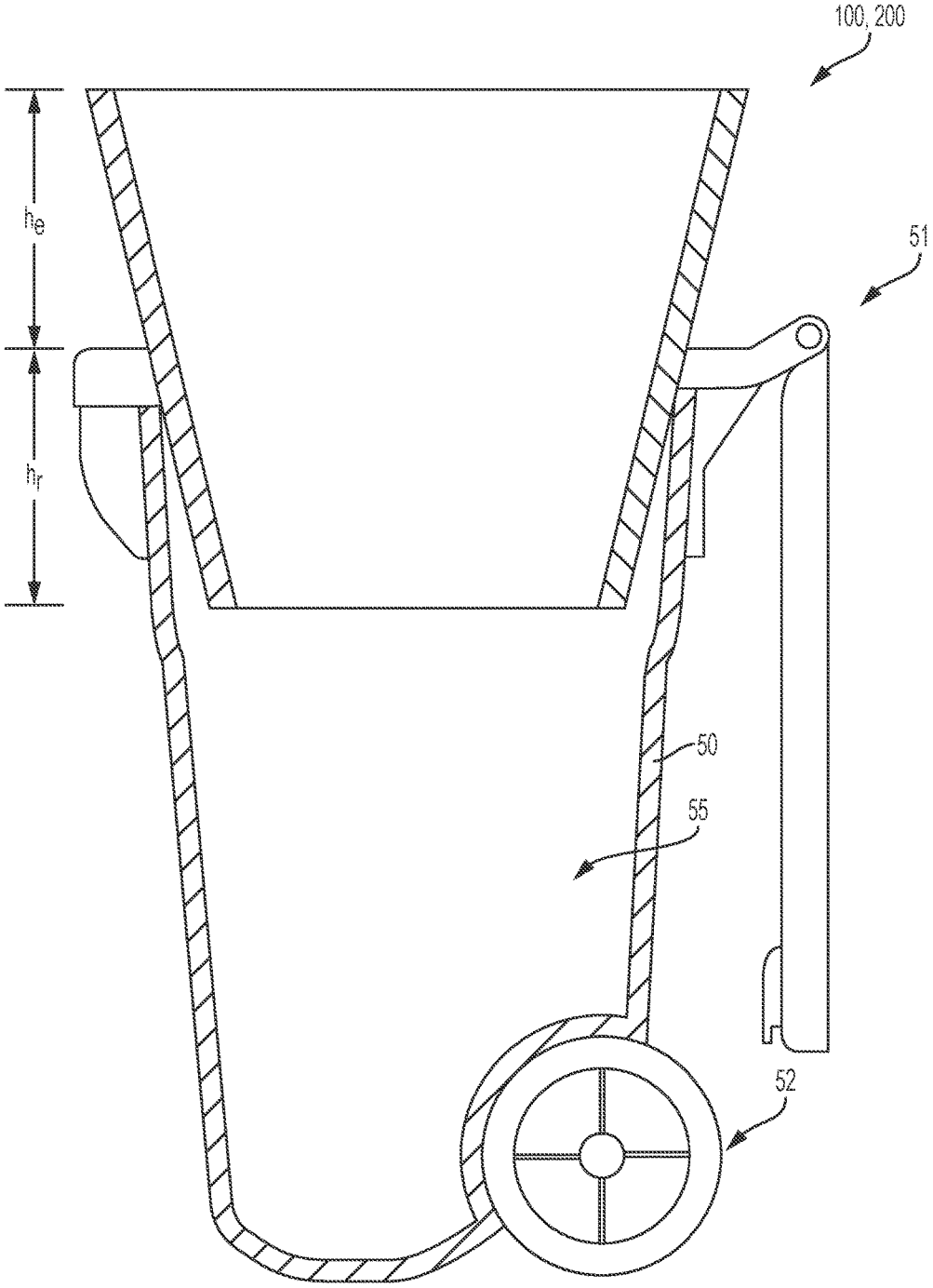
FIG. 6 depicts a sectional view of an embodiment of an extender operably configured with an embodiment of a receptacle.

Referring now to FIGS. 5 and 6, embodiments of extender 100, 200 are shown in an operable configuration and engaged with receptacle 50. The extender 100, 200 may be provided to an end user as a flat and/or folded unit, as described above, or may be provided to an end user partly folded or otherwise intact. If the extender 100, 200 comes in a folded or flat unit, a user may manipulate the plurality of walls 40*a*, 40*b*, 41*a*, 41*b* to form a box-like structure, as shown in FIGS. 5 and 6. Once assembled or otherwise formed into a box-like structure, the extender 100, 200 may be inserted within an interior 55 of the receptacle 50. Embodiments of the extender 100, 200 may be placed within the receptacle 50 from a top end 51 and driven further into the interior 55 of the receptacle 50. Because embodiments of the extender 100, 200 may be tapered, further displacement into the interior 55 of the receptacle 50 eventually results in mechanical interference between the walls 40*a*, 40*b*, 41*a*, 41*b*, or one or more deflection flaps 36, 236, and an inner surface 54 of the receptacle 50. The extender 100, 200 may be driven/pushed, forced, placed, etc. into the interior 55 of the receptacle 50 a distance, $h_r$, so as to provide a friction fit between the two components to prevent, hinder, or impede dislocation of the extender 100, 200 while the receptacle 50 is an upright, storage/collection position, as shown in FIGS. 5 and 6. In some embodiments, the extender 100, 200 may include a lip, edge, protrusion, or other surface feature that extends perpendicularly or substantially perpendicularly from an inner surface 34, 234 proximate, at, or otherwise near the second end 32, 232. The lip or engagement surface may extend perpendicularly into a center of the interior space 35, 235 so that waste materials 15 added into the extender 100, 200 may engage the lip to further hinder dislocation of the extender 100, 200 from the receptacle 50. The lip may be bent inwards by a user or may come perforated or creased for easy folding. The distance, represented by $h_r$, the extender 100, 200 enters the interior 55 of the receptacle 50 may vary and may depend on a size of the receptacle 50. In this position, the extender 100, 200 may be physically pulled out from and removed from the receptacle 50 by a user, but may be able to withstand other external forces such as wind, rain, addition of waste materials 55 to the receptacle, and the like. Furthermore, in this position, the extender 100, 200 may protrude, extend, or otherwise rise from a top end 51 of the receptacle 50 a distance, $h_e$, which may represent an increased storage capacity for waste materials 15. For instance, when waste materials 15 fill or substantially fill the interior 55 of the receptacle 50, the extender 100, 200 may be utilized to add an additional storage volume to the receptacle 50. The volume added depends on the distance, $h_e$, or height, the walls 40*a*, 40*b*, 41*a*, 41*b* extend from a top end 51 of the receptacle 50, as well as the width of each of the walls 40*a*, 40*b*, 41*a*, 41*b*. Thus, additional waste materials 15 (i.e. in addition to waste materials 15 already stored or located within the interior 15 of the receptacle 50) may be collected, stored, accommodated, received, etc. between the walls 40*a*, 40*b*, 41, 41*b* of the extender 100, 200, when the extender 100, 200 is engaged with the receptacle 50.

Figure 7:
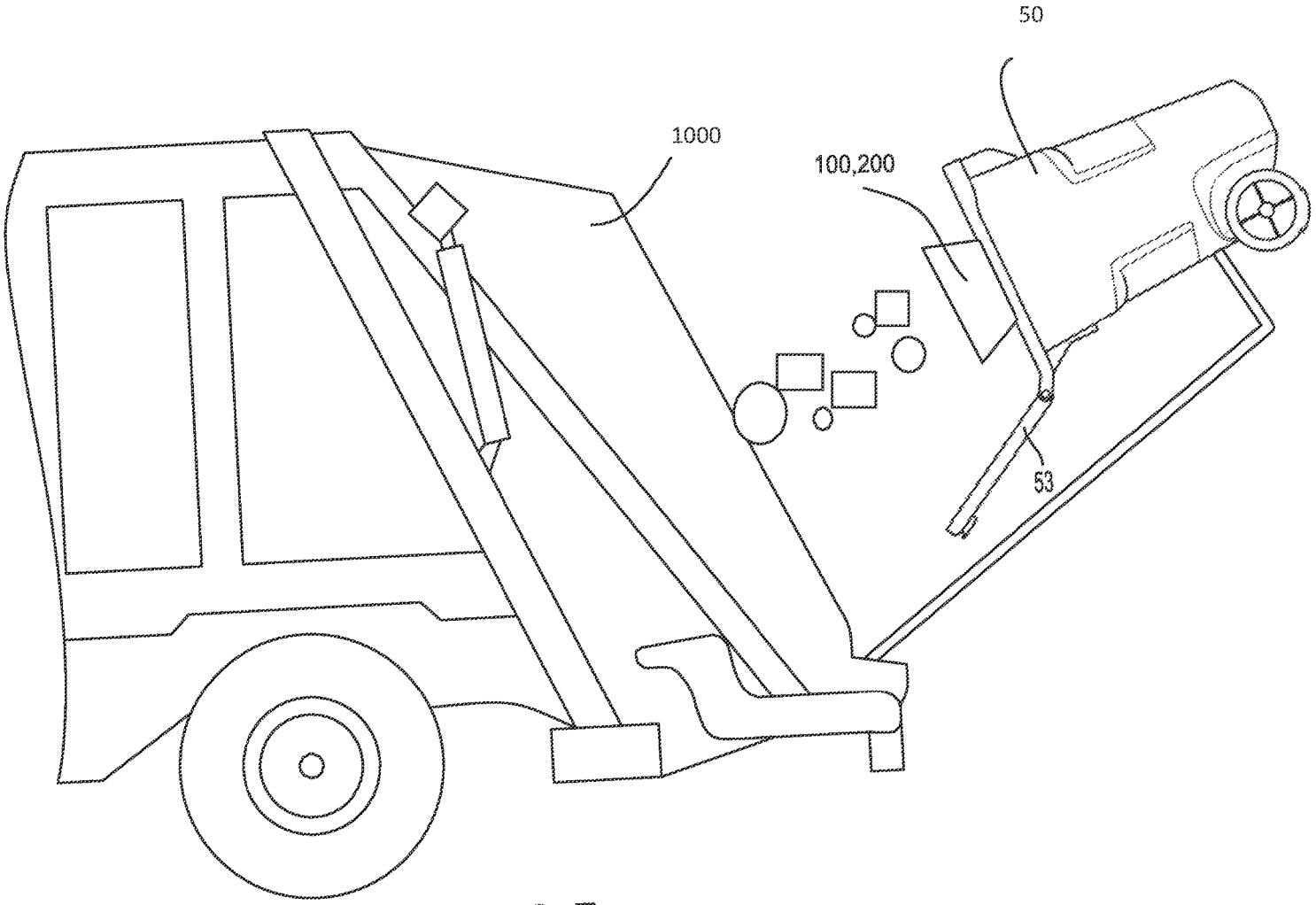
FIG. 7 depicts a schematic view of a first position of a receptacle being lifted and inverted for removal of waste contents.
Figure 8:
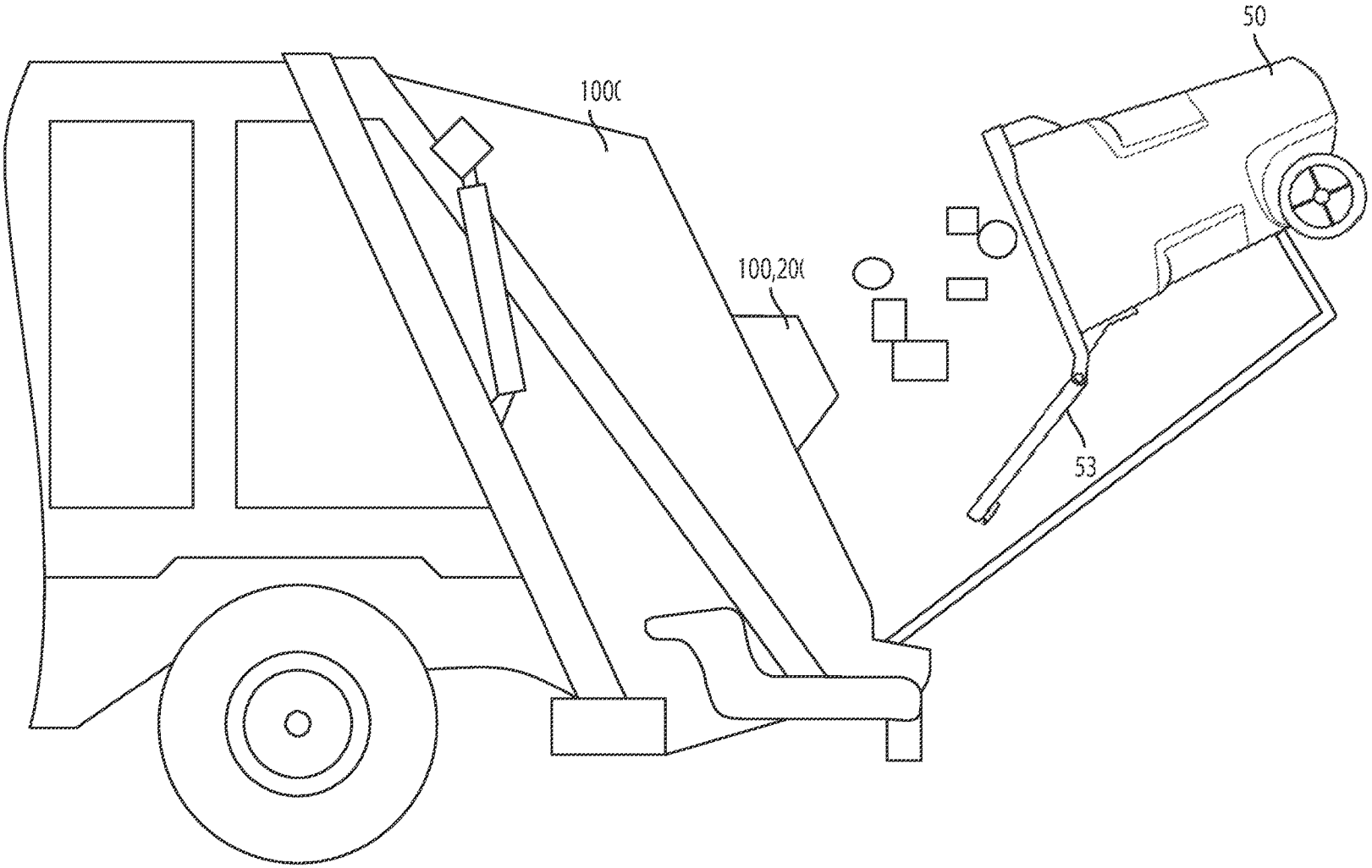
FIG. 8 depicts a schematic view of a second position of a receptacle being lifted and inverted for removal of waste contents.

With reference now to FIGS. 7 and 8, a manner in which the waste materials 15 and the extender 100, 200 may be disposed is now described. While the receptacle 50 is in an upright, collection position, with the extender 100, 200 operably engaged with the receptacle 50, waste materials 15 may be collected and stored for eventual pickup and removal by a garbage removal company or municipality service. When it comes time for the waste materials 15 to be picked up and removed, the garbage collectors may utilize a collection vehicle 1000, such as a garbage truck, to secure, grab, or otherwise manipulate the receptacle 50 to invert, at least to some degree, the receptacle 50 to allow the waste materials 15 to exit the interior 55 of the receptacle 50 and into a collection area of the collection vehicle 1000. As shown in FIG. 7, an initial amount or portion of the waste materials 15 may exit the extender 100, 200 and/or the receptacle 50 and into the collection area of the collection vehicle 1000. As the waste materials 15 continue to exit the receptacle 50, a weight of the remaining waste materials 15 passing by the extender 100, 200 may engage the extender 100, 200, for example, may engage an internal lip of the extender 100, 200 proximate the second end 32, 232, and may help drive or otherwise urge the extender 100, 200 out of physical engagement with the inner surface 55 of the receptacle 50, and into the collection area of the collection vehicle 100 along with other waste materials 15, as shown in FIG. 8. Therefore, the waste materials 15 and the extender 100, 200 are efficiently disposed of and collected in a single motion—or a single lift and invert of the receptacle 50. This may save time for the garbage collectors because they do not need to stop, bend over, and hand collect waste material stacked next to the receptacle 50 because the receptacle 50 lacked the capacity to store all of the waste. Further, no additional time may be wasted to collect the additional waste materials 15 collected/stored by the presence/use of the extender 100, 200 because the extender 100, 200 may be disposed of and collected by the garbage collection vehicle 1000 in the same motion as if just collecting the waste stored in the receptacle 50.

In alternative embodiments, a garbage collector(s) may physically lift and invert the receptacle 50 with the extender 100, 200 attached thereto and empty into a garbage collection vehicle 1000, or suitable collection means. The extender 100, 200 may likewise disengage from the receptacle 50 for disposal along with the waste materials 15.

Figure 9:
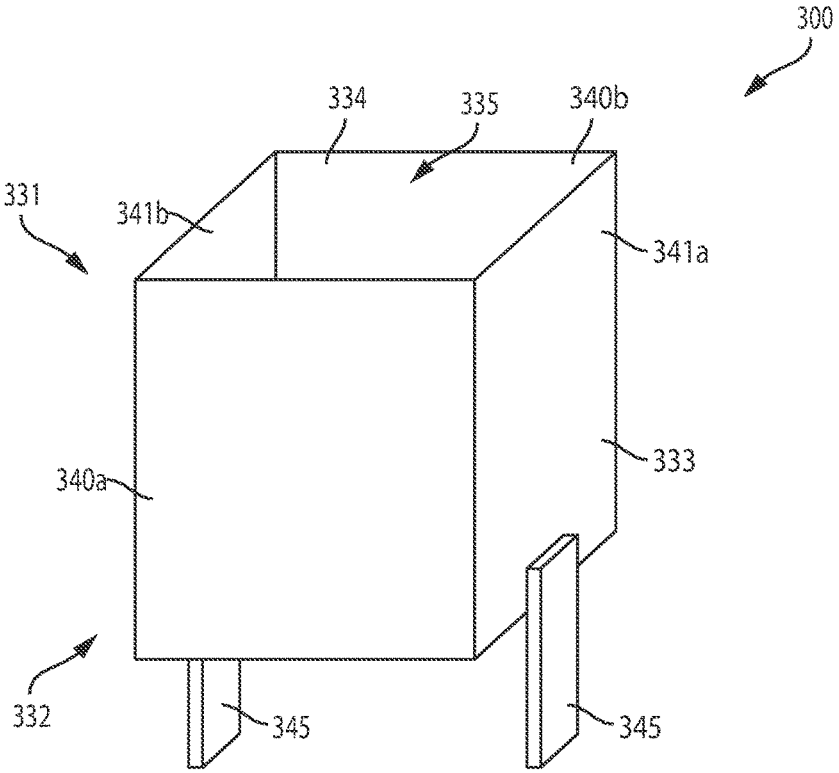
FIG. 9 depicts a perspective view of a third embodiment of an extender.
Figure 10:
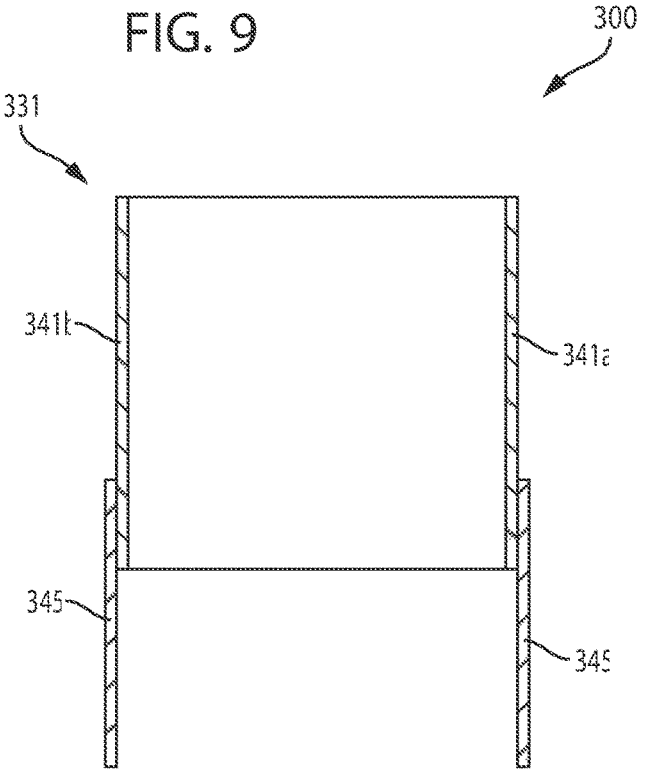
FIG. 10 depicts a sectional view of the third embodiment of an extender.

With continued reference to the drawings, FIGS. 9 and 10 depict an embodiment of extender 300. Embodiments of extender 300 may be a box, an add-on, a cardboard structure, a garbage containment unit, a cardboard accessory, or the like, sized and dimensioned to be placed on top of a cover 53 of a receptacle 50 of various sizes. The extender 300 may be a device that may be configured to be placed upon a cover 53 of a receptacle 50, such as industry standard sized garbage can, to extend or otherwise increase a capacity of the receptacle 50. The increased capacity may be an amount of volume for storing garbage, waste, yard waste, leaves, etc., or any contents suitable for placement in a receptacle that is in addition to a maximum volume afforded by the receptacle 50. For example, if the receptacle 50 becomes full of waste materials 15, such as garbage, waste, recyclables, yard waste, and the like, any additional waste materials will not fit properly within the receptacle 50, and likely fall to the side of the receptacle 50, or can blow away due to the wind or other environmental elements. To increase a volume or storage capacity of the receptacle 50, embodiments of an extender 300 may be placed on a top of a receptacle 50 so that additional waste materials 15 may be stored in addition to the waste material already stored within the receptacle 50. While the extender 300 is operatively attached to the receptacle 50, a storage capacity of the receptacle 50 is effectively increased because of the additional capacity or volume afforded by the extender 300. Embodiments of the receptacle 50 may be a garbage can, a pail, a garbage pail, a transportable waste container, a waste collection device, a barrel, a bucket, and the like. In some embodiments, the receptacle 50 may include a cover 53 that can be hingedly or otherwise pivotally attached to the receptacle 50. Further, embodiments of receptacle 50 may be various sizes, as might be offered/provided by a waste collection company or a municipality, or otherwise available for purchase at a home improvement store.

Embodiments of extender 300 may include a first end 331, a second end 332, an outer surface 333, an inner surface 334, and a general opening extending therethrough. Moreover, embodiments of the extender 300 may include a plurality of walls 340*a*, 340*b*, 341*a*, 341*b*. Each of the plurality of walls 340*a*, 340*b*, 341*a*, 341*b* may be shaped like a square or rectangle to form a box-like configuration having an interior space 335. A number and an arrangement of the plurality of walls, when operably configured, may correspond to a geometric shape of a cover 53 of the receptacle 50 so that it may efficiently rest upon a cover 53 of the receptacle 50. In one embodiment, the extender 300 may include four walls, with a front wall 340*a*, a back wall 340*b*, a first side wall 341*a*, and a second side wall 341*b*; embodiments of the extender 300 may include an optional bottom wall and/or a top wall, wherein the top wall may be opened when needed to place contents therein and closed to hinder access, provide protection against rain or other environmental elements, and/or minimize odor. For instance, a top wall may be movably or pivotally attached to the at least on the walls 340*a*, 34*b*, 341*a*, 341*b*. The walls 340*a*, 340*b*, 341*a*, 341*b* may be equal in size, or may vary in size with respect to each other. Furthermore, the walls 340*a*, 340*b*, 341*a*, 341*b* may be structurally integral with each other and joined along each edge to the next wall, as shown in FIG. 9. The edges may be creased or pre-creased to facilitate or promote flexibility of the extender 300. The flexibility of the extender 100 may vary, but in some cases, the extender 300 may be able to be folded into a flat unit, while all of the edges of the walls 340*a*, 340*b*, 341, 341*b* remain connected, structurally integral or otherwise.

Furthermore, embodiments of extender 300 may include at least one edge of one of the plurality of walls 340*a*, 340*b*, 341*a*, 341*b* may be a free edge, which may also allow the extender 300 to be packaged and sold as a flat, or relatively flat, or a folded flat unit. For example, a left edge of front wall 340*a* may be a free edge, while the other, right, edge of the front wall 340*a* is connected to the left edge of first side wall 341*a*. In this example, an edge of the second side wall 341*b* may also be a free edge. Any configuration or combination of free edges may be implemented to form extender 300. In some operable configurations, the free edges may be connected to each other for added stability once ready for use. For instance, the free edges may be connected to each other using a connection element, such as a component similar to connection element 245 described supra. In other operable configurations, the free edges may remain unconnected when placed within the receptacle 50, wherein the free edges are proximate or otherwise near each other when in this operable configuration.

Figure 11:
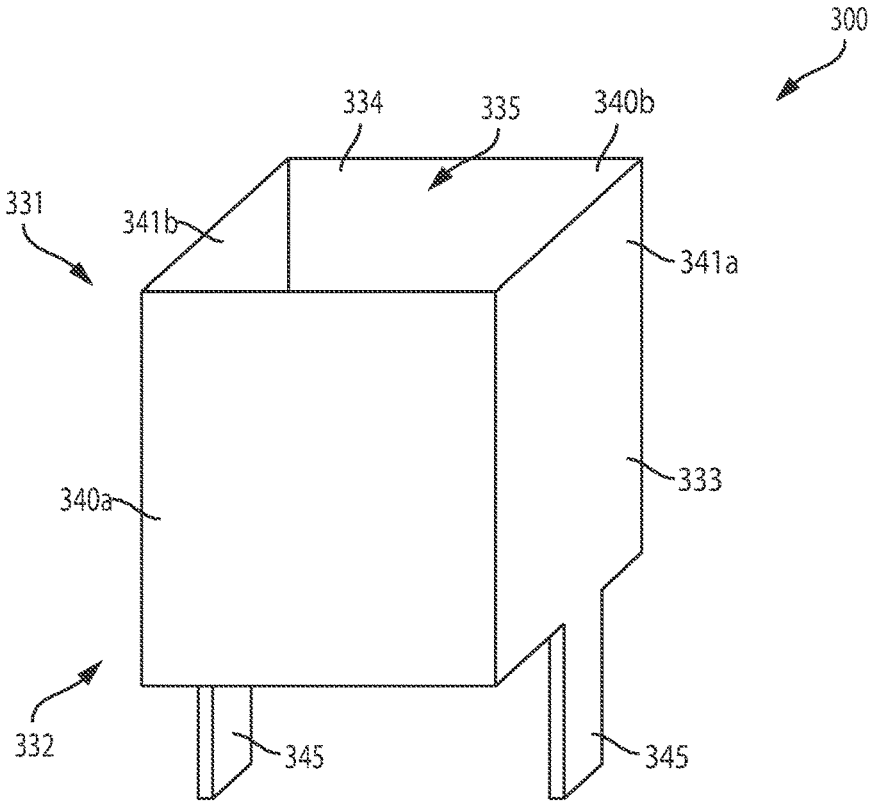
FIG. 11 depicts a perspective view of the third embodiment of an extender having at least one structurally integral wing.
Figure 12:
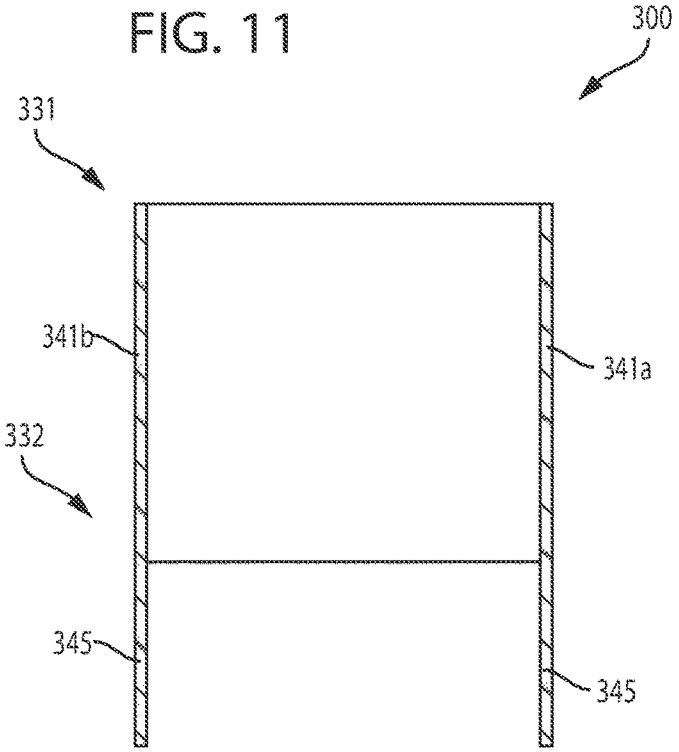
FIG. 12 depicts a sectional view of the third embodiment of an extender having one or more structurally integral wing.

Referring still to FIGS. 9 and 10, embodiments of extender 300 may include one or more wings 345. Embodiments of the one or more wings 345 may be a wing, a strap, a flap, a connector, a securing strap, a securing element, and the like. Embodiments of the one or more wings 345 may be a separate section of material that is operably attached to one or more walls, such a first side wall 341*a* and a second side wall 341*b*. For example, wings 345 may be affixed, adhered, stapled, or otherwise secured to one or more side walls of the extender 300. Alternatively, embodiments of wings 345 may be structurally integral with one or walls 340*a*, 340*b*, 341*a*, 341*b* of the extender 300, as shown in FIGS. 11 and 12. Embodiments of the one or more wings 345 may protrude, extend, or hang down beyond a second end 332 of the extender 300 a distance to allow the wings 345 to be manipulated for operable engagement with the receptacle 50. Furthermore, embodiments of the extender 300 may be made out of cardboard or other suitable material. The material(s) forming the extender 300 may be disposable. However, in some embodiments, the extender 300 may be made of a material that can be reused without significant risk of damage if exposed to environmental elements. In further embodiments, the extender 300 may be made out a metal, such as aluminum, or plastic and can be recycled with the other contents within the receptacle 50, such as known recyclable items that are commonly discarded. In even further embodiments, waste materials 15 may be segregated by type/contents by locating certain materials in the extender 300, and the more conventional or non-hazardous contents in the interior 55 of the receptacle 50. For example, normal waste materials 15 may be kept in the receptacle 50, while batteries may be placed within the interior space 335 of the extender 300 to separate the contents, making it easier for collection companies to sort contents. Sorting contents may be made easier because the contents of extender 300 may be dumped into a separate compartment of the collection vehicle 1000 (e.g. recyclables, hazardous, etc.)

Figure 13:
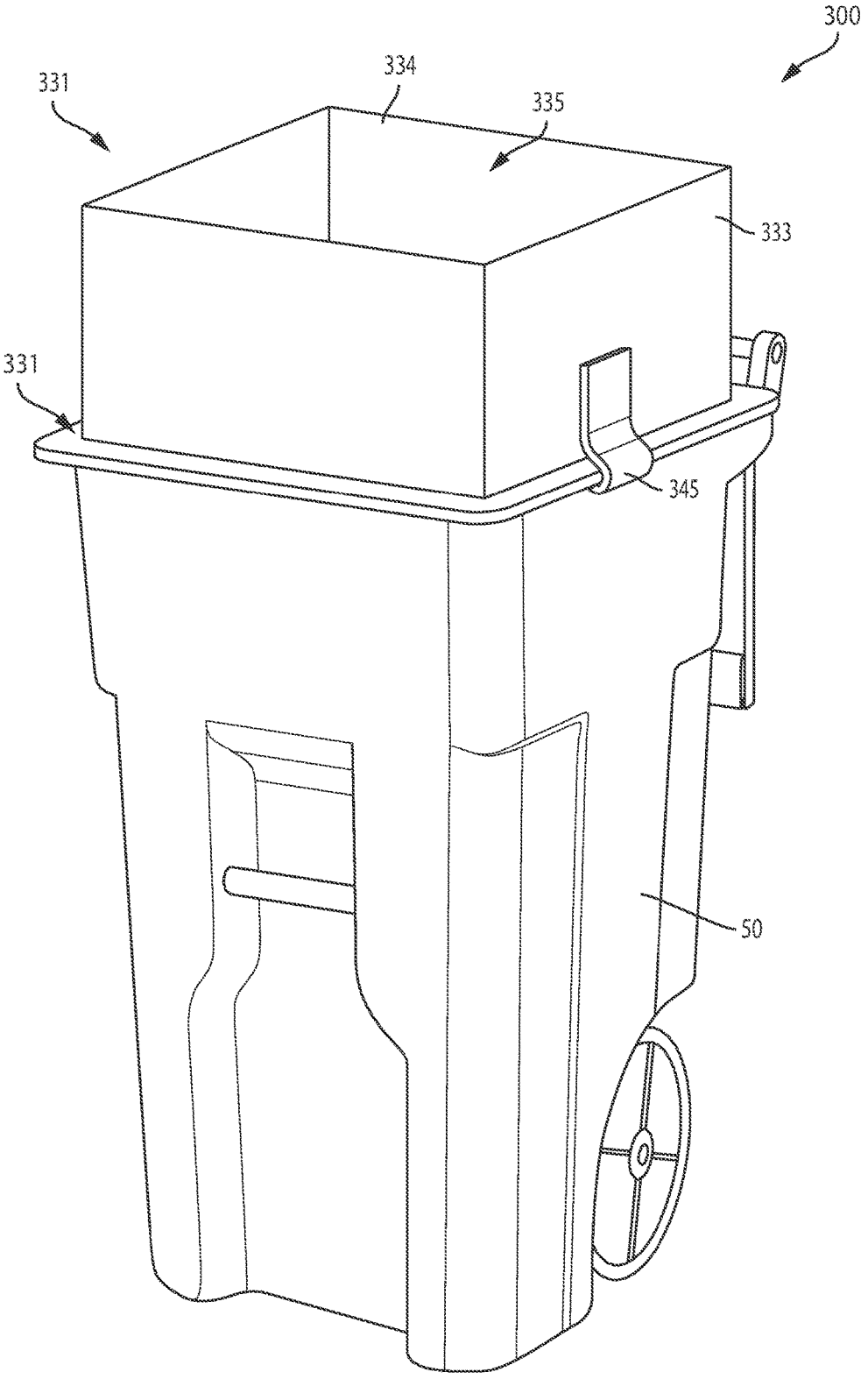
FIG. 13 depicts a perspective view of the third embodiment of the extender operably configured with an embodiment of a receptacle.
Figure 14:
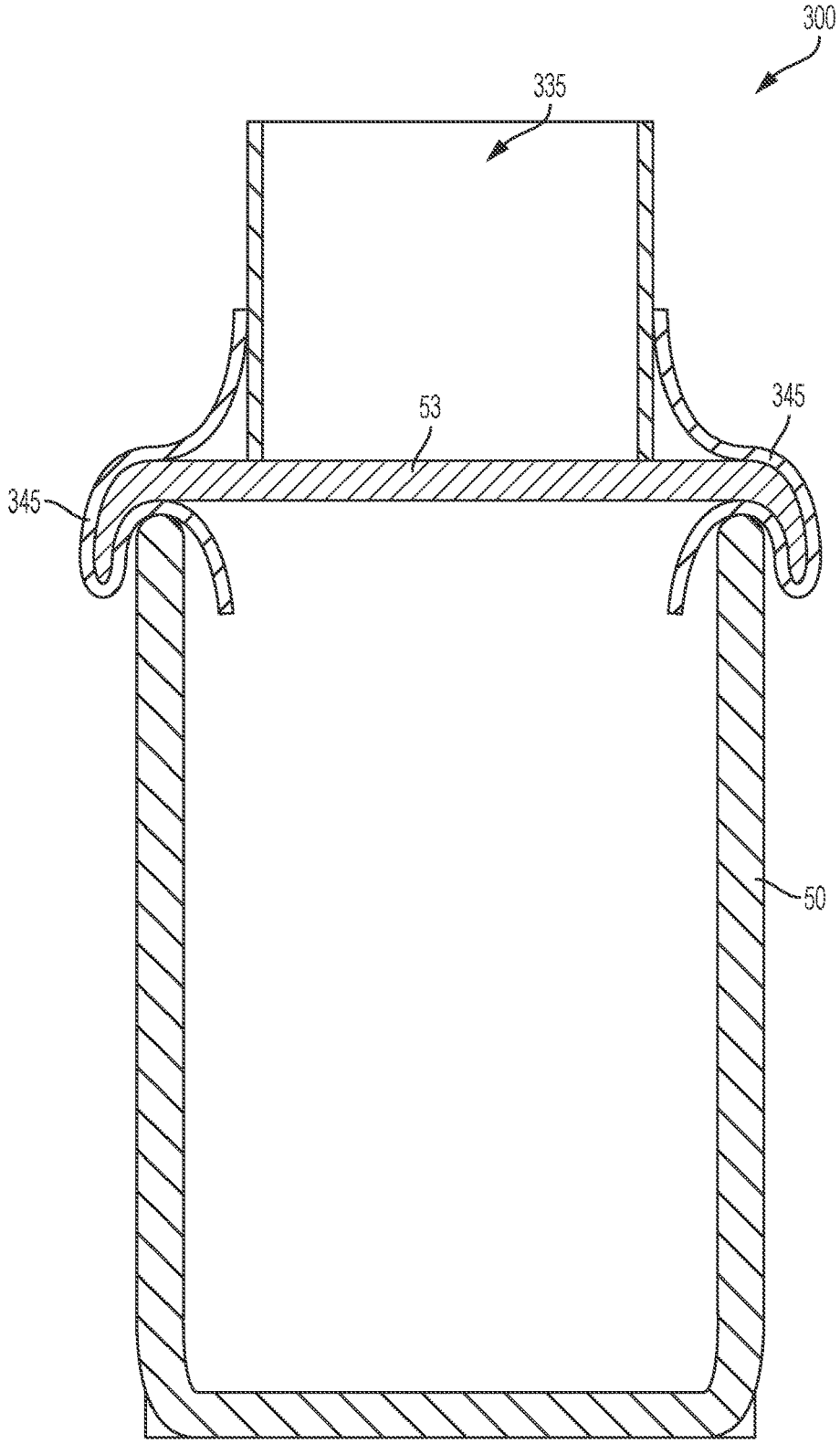
FIG. 14 depicts a sectional view of the third embodiment of the extender operably configured with an embodiment of a receptacle.

Referring now to FIGS. 13 and 14, an embodiment of extender 300 is shown in an operable configuration and engaged with receptacle 50. The extender 300 may be provided to an end user as a flat and/or folded unit, as described above, or may be provided to an end user partly folded or otherwise intact. If the extender 300 comes in a folded or flat unit, a user may manipulate the plurality of walls 340*a*, 340*b*, 341*a*, 341*b* to form a box-like structure, as shown in FIGS. 8-11. Once assembled or otherwise formed into a box-like structure, the extender 300 may be placed on a cover 53 of a receptacle 50 (e.g. when the cover 53 is closed over a top end 51 of the receptacle 50). Because the one or more wings 345 may protrude, extend, or hang down beyond a second end 332 of the extender 300 a distance, the wings 345 may be manipulated so as to be placed underneath a cover 53 of the receptacle 50 and into an interior 55 of the receptacle 50. For instance, a user may place the extender 300 on top of the receptacle 50, and at least slightly open the cover 53, and when the cover 52 is at least slightly open, the user may insert the one or more wings 345 into the interior 55 of the receptacle 50, and then return the cover 53 to a closed position. A weight of the cover 53 may secure the extender 300 in a collection position atop the receptacle 50, thus affording the receptacle 50 an increased storage capacity for waste materials 15. As more waste materials 15 are placed within the interior space 335 of the extender 300, an additional weight/force can be applied to the cover 53, thus increasing the force exerted against the one or more wings 345.

Accordingly, in this position, the extender 300 may protrude, extend, or otherwise rise from a top cover 53 of the receptacle 50 a distance, which may represent an increased storage capacity for waste materials 15. For instance, when waste materials 15 fill or substantially fill the interior 55 of the receptacle 50, the extender 300 may be utilized to add an additional storage volume to the receptacle 50. The volume added depends on the distance, or height, the walls 340*a*, 340*b*, 341*a*, 341*b* extend from a top end 51 of the receptacle 50, as well as the width of each of the walls 340*a*, 340*b*, 341*a*, 341*b*. Thus, additional waste materials 15 (i.e. in addition to waste materials 15 already stored or located within the interior 15 of the receptacle 50) may be collected, stored, accommodated, received, etc. between the walls 340*a*, 340*b*, 341, 341*b* of the extender 300, when the extender 300 is engaged with the receptacle 50.

Figure 15:
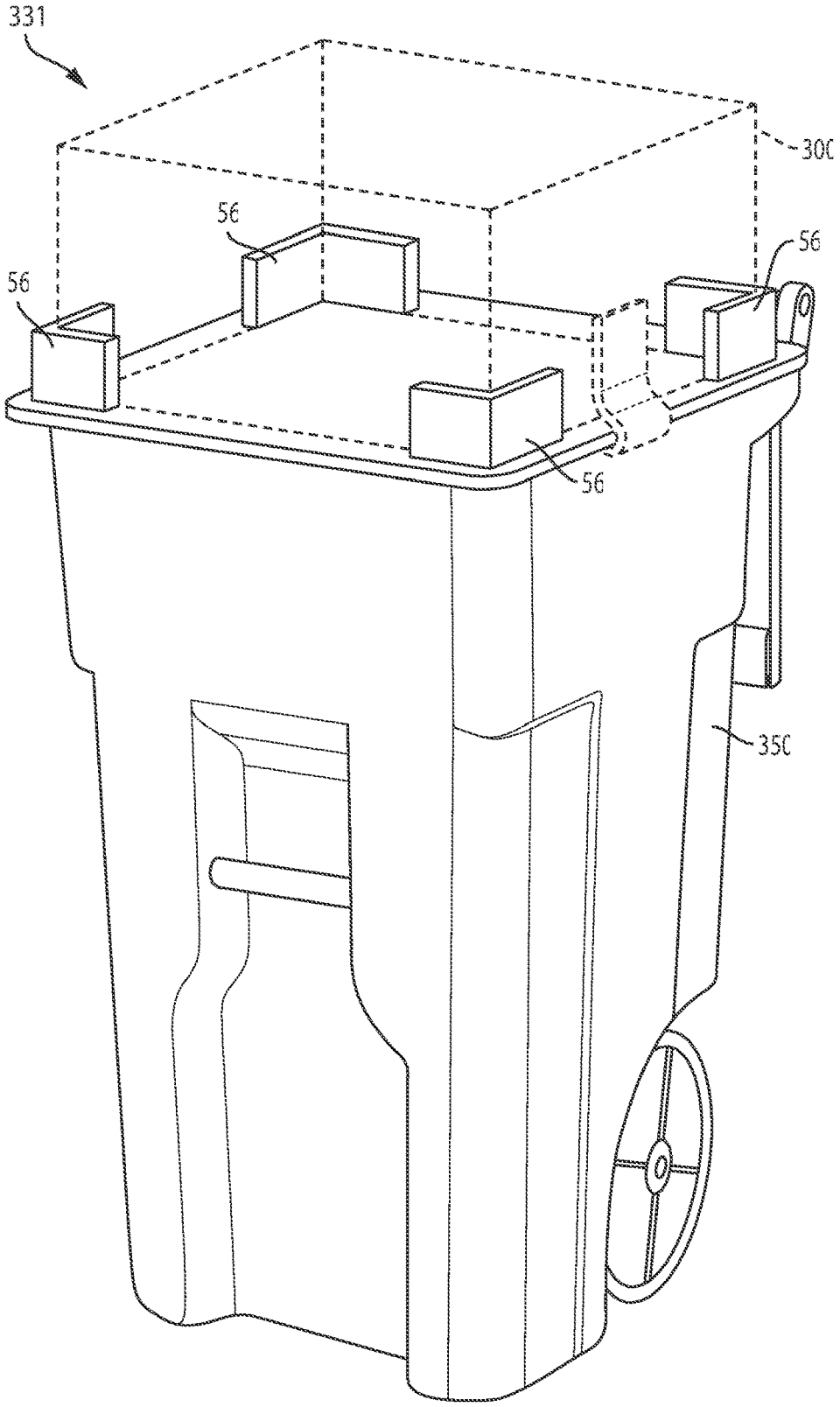
FIG. 15 depicts a perspective view of an embodiment of a receptacle having a plurality of support elements.

FIG. 15 depicts an embodiment of a receptacle 50 that may include a plurality of support elements 56. Embodiments of support elements 56 may be supports, box supports, extender supporters, framing elements, guide elements, corner elements, or any suitable component for preventing or hindering slidable movement of the extender 300 across the cover 53 of the receptacle 50 when placed atop the receptacle 50. Embodiments of the support elements 56 may be positioned in or more corner locations of the cover 53 of the receptacle 50. Additionally, support elements 56 may be positioned on the cover 53 at a location that may correspond to where a wall 340*a*, 340*b*, 341*a*, 341*b* engage the cover 53 of the receptacle 50. Embodiments of the support elements 56 may include a right angle or a substantially right angle to accommodate or correspond with a corner of the extender 300. Embodiments of the support elements 56 may include a first wall and a second wall, or a single wall, that may protrude or extend upwards from the cover 53 of the receptacle. Thus, an extender 300 may be placed between the support elements 56, wherein the support elements 56 may prevent or hinder slidable movement of the extender 300 to help retain the extender 300 in position. Further, embodiments of the support elements 56 may be structurally integral with the cover 53, or may be separately attached to the cover 53, and may be made of the same or different material of the cover 53. In most embodiments, the support elements 56 may be comprised of a rigid material.

Figure 16:
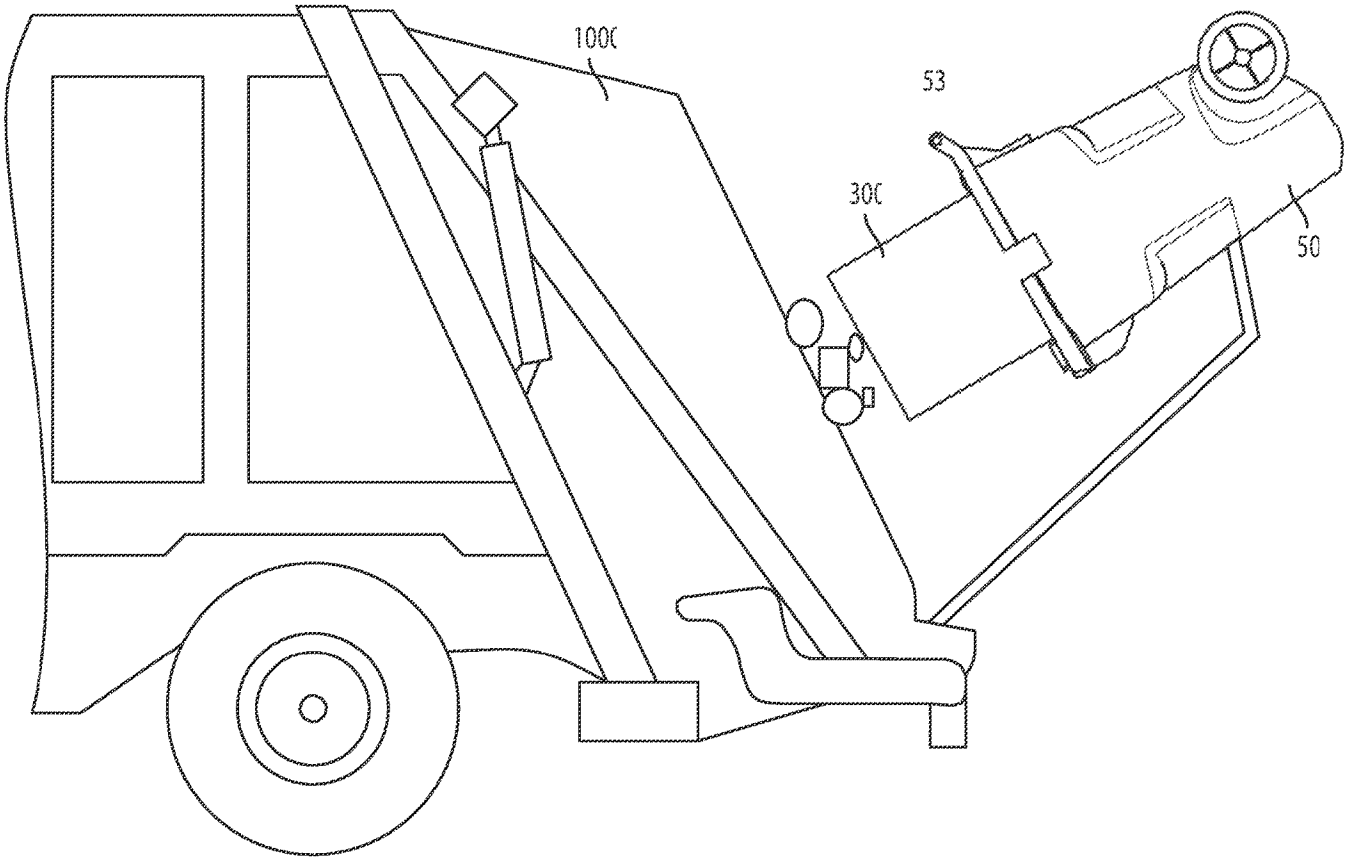
FIG. 16 depicts a schematic view of a first position of a receptacle being lifted and inverted for removal of waste contents.
Figure 17:
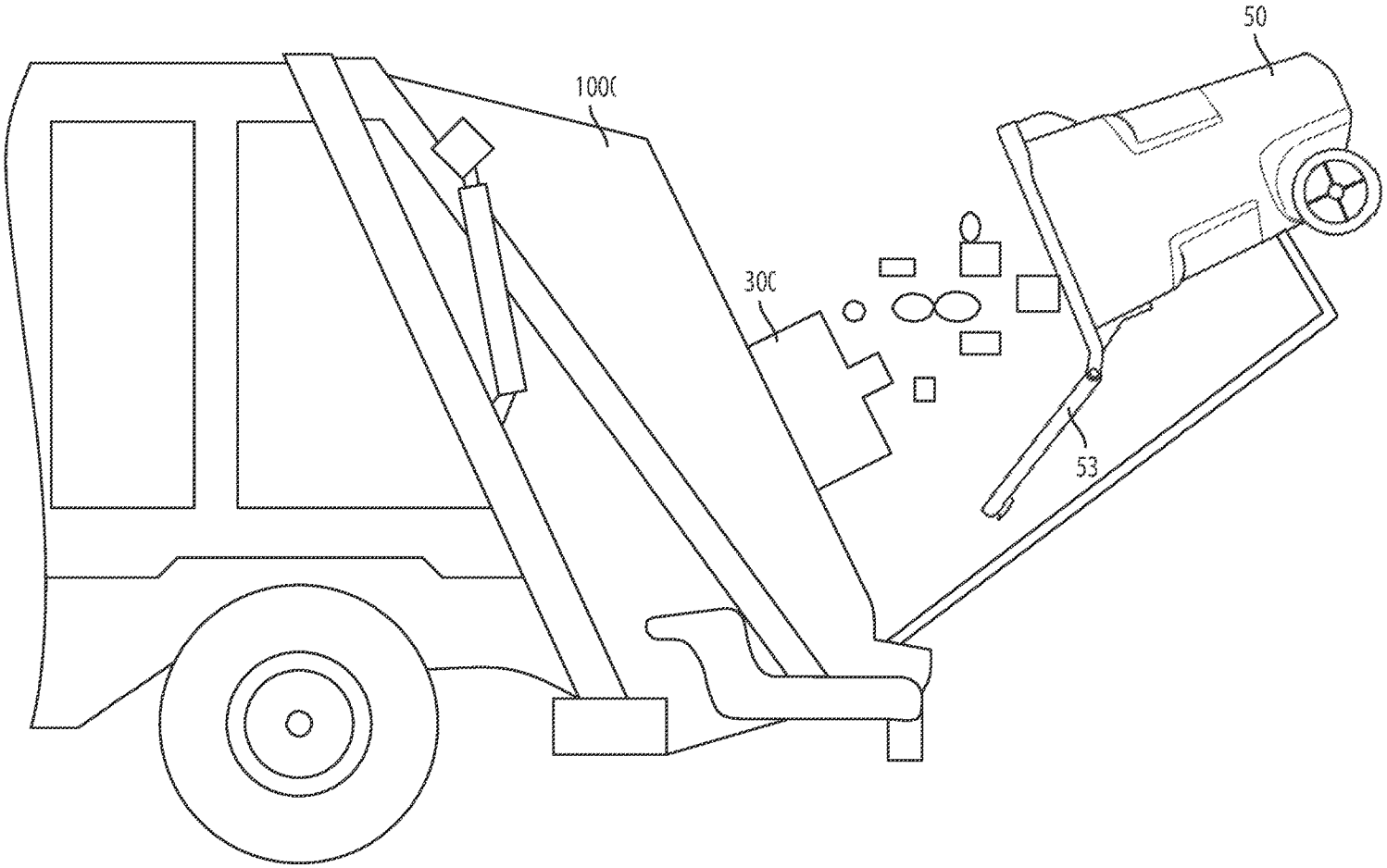
FIG. 17 depicts a schematic view of a second position of a receptacle being lifted and inverted for removal of waste contents.

With reference now to FIGS. 16 and 17, a manner in which the waste materials 15 and the extender 300 may be disposed is now described. While the receptacle 50 is in an upright, collection position, with the extender 300 operably engaged with the receptacle 50, waste materials 15 may be collected and stored for eventual pickup and removal by a garbage removal company or municipality service. When it comes time for the waste materials 15 to be picked up and removed, the garbage collectors may utilize a collection vehicle 1000, such as a garbage truck, to secure, grab, or otherwise manipulate the receptacle 50 to invert, at least to some degree, the receptacle 50 to allow the waste materials 15 to exit the interior 55 of the receptacle 50 and into a collection area of the collection vehicle 1000. As shown in FIG. 15, an initial amount or portion of the waste materials 15 may exit the extender 300 into the collection area of the collection area. As the waste materials 15 exit the extender 300 and the receptacle 50 is at least partially inverted, the cover 53 also begins to open, releasing the one or more wings 345 of extender 300. When the one or more wings 345 are released (i.e. the cover 53 no longer pinches the wings 345 against a top lip of the receptacle 50), the extender 300 is physically disengaged with the receptacle 50, and drops into the collection area of the collection vehicle 100 along with other waste materials 15, as shown in FIG. 16. Therefore, the waste materials 15 and the extender 300 are efficiently disposed of and collected in a single motion—or a single lift and invert of the receptacle 50. This may save time for the garbage collectors because they do not need to stop, bend over, and hand collect waste material stacked next to the receptacle 50 because the receptacle 50 lacked the capacity to store all of the waste. Further, no additional time may be wasted to collect the additional waste materials 15 collected/stored by the presence/use of the extender 300 because the extender 300 may be disposed of and collected by the garbage collection vehicle 1000 in the same motion as if just collecting the waste stored in the receptacle 50.

In alternative embodiments, a garbage collector(s) may physically lift and invert the receptacle 50 with the extender 300 attached thereto and empty into a garbage collection vehicle 1000, or suitable collection means. The extender 300 may likewise disengage from the receptacle 50 for disposal along with the waste materials 15.

Figure 18:
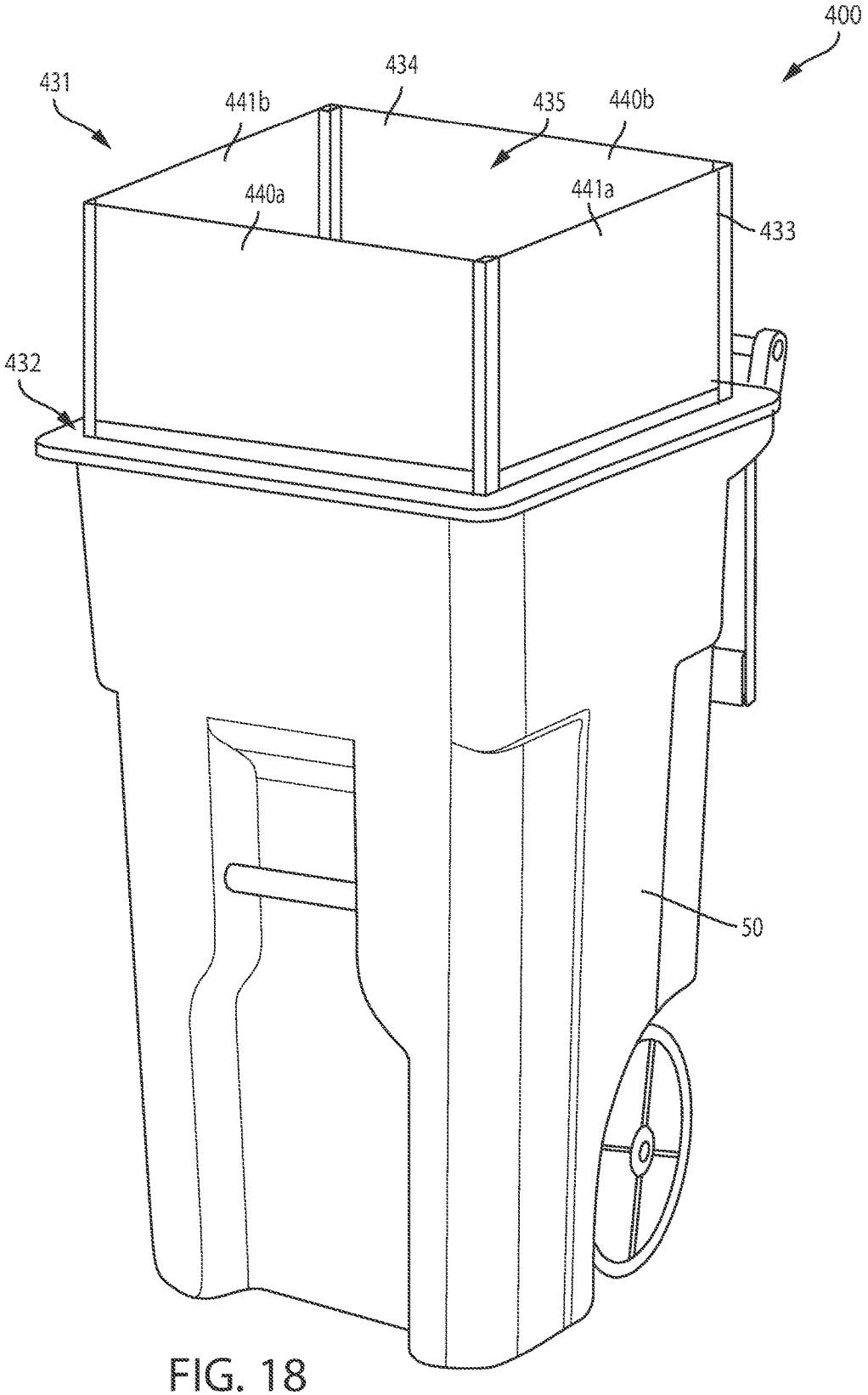
FIG. 18 depicts a perspective view of a fourth embodiment of an extender operably configured with a receptacle.
Figure 19:
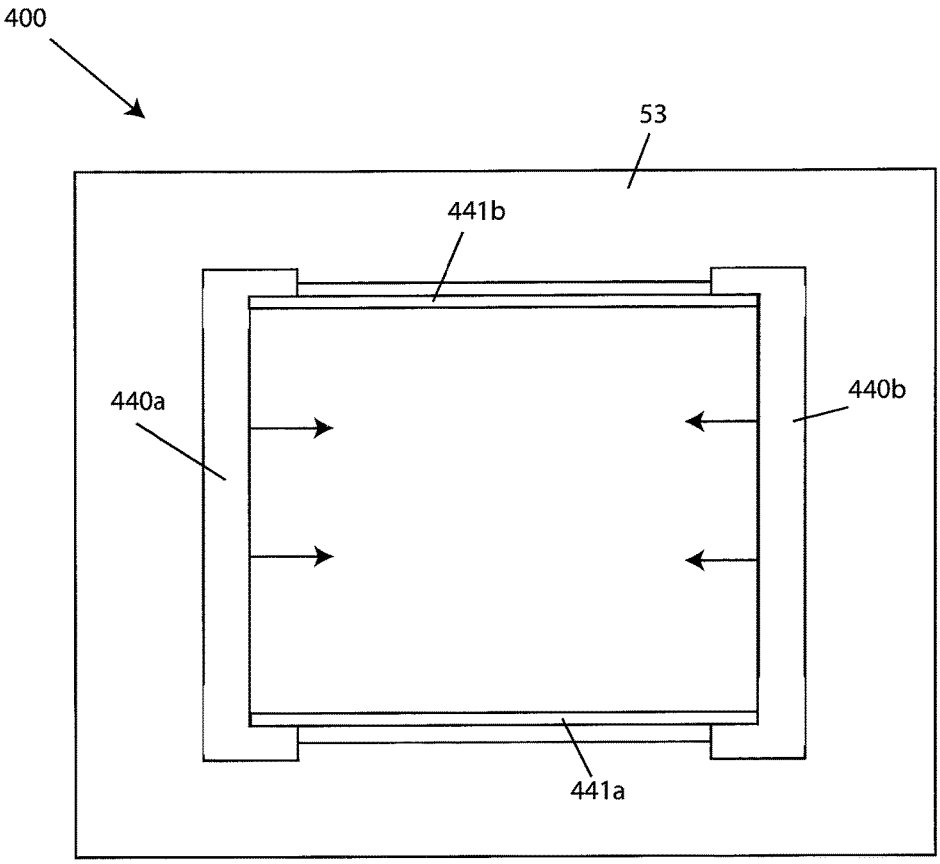
FIG. 19 depicts a top view of the fourth embodiments of an extender operably configured with a receptacle.

FIGS. 18 and 19 depict yet another embodiment of an extender 400. Embodiments of extender 400 may be permanently attached to a receptacle 50. For instance, embodiments of extender 400 may be permanently attached to a cover 53 of the receptacle 50. Embodiments of extender 400 may be collapsible, such that when additional storage capacity is not needed, the extender 400 may be collapsed into a first, flat position, and when needed to increase a storage capacity of the receptacle 50, the extender 50 may be unfolded or moved to a second, erect position. Moreover, embodiments of the extender 400 may include a plurality of walls 440*a*, 440*b*, 441*a*, 441*b*, an outer surface 433, and inner surface 434, and an interior space 435 to accommodate waste materials 15. At least two of the walls 440*a*, 440*b*, 441*a*, 441*b* may be spring loaded and hingedly movable from a flat position to an upright, erect position. While the spring loaded walls are held erect or partially erect, another wall, which may not be spring loaded, can be raised to fit between the spring loaded wall. The force of the spring loaded wall acting on either side of the free standing wall will keep the walls erect, and in the second, upright position configured to received and store waste materials 15 beyond or in addition to the waste materials 15 stored within the receptacle 50. A remaining wall, which may not be spring loaded, may also be lifted upright so as to fit between the spring loaded walls to complete the extender 400. While embodiments of extender 400 may not be disposable, the method and manner in which the contents of both the extender 400 and receptacle 50 are emptied may be similar to the methods described with respect to extender 100, 200, 300.

Referring now to FIGS. 1-19, and additional reference to FIG. 20, embodiments of a method for collecting garbage may include a step of providing a receptacle, such as receptacle 50, for storing waste materials. For example, a garbage collecting service may provide homeowners, users, renters, etc. with a receptacle 50 of a certain size, wherein the receptacle 50 may be configured to be lifted and inverted by a mechanical means of a garbage collection vehicle 1000 to empty the waste materials 15 within the receptacle 50. Another step may be to provide an extender 100, 200, 300 for use with the receptacle 50, the extender cooperating with the receptacle 50 to increase a storage capacity of the provided receptacle 50, wherein the extender 100, 200, 300 is disposable along with the waste materials 15. Another step may be collecting the waste materials 15 and the extender 100, 200, 300 at the same time, using the mechanical means of the garbage collection means 1000. For example, the extender 100, 200, 300 and the receptacle 50 may be emptied of waste materials in a same motion. This method may save labor time for the garbage collectors because a driver or operator(s) may stay in the truck and pick up the receptacle according to existing methods, yet dump the contents of the extender (and potentially the extender itself) in the same motion. Moreover, the method may allow customers to purchase a smaller trash service (e.g. smaller size container) with a temporary means in which to increase a capacity of the purchased receptacle. The disposability of the extender 100, 200, 300 may be a cost-effective alternative to buying a larger receptacle service, and may be a way for a garbage service collection company to secure more customers by including one or more extenders in a package.

Referring now to FIGS. 21-26, another embodiment of an extender 500 is shown made out of a flat piece of material. For instance, the extender 500 may be made of a flat, rectangular piece of material (e.g. cardboard, plastic, corrugated plastic, etc.). wherein the flat, rectangular piece of material may be manipulated to create at least one tapered corner for biasingly engaging a surface of a garbage can. The flat piece of material may be continuous. The extender 500 is shown having a top edge 505 and a bottom edge 506, an outer surface 533, an inner surface 534, a plurality of sides 540*a*, 540*b*, 541*a*, and 541*b*, and a plurality of folds 501, 502, 503, and 504. The extender 500 may have a tapered shape formed by the plurality of folds 501, 502, 503, and 504 that are made in the flat piece of material. The flat piece of material may have a body structure that is formed by attaching or affixing first edge 507 of the flat piece of material to second edge 508. First edge 507 and second edge 508 of the flat piece of material may be opposing. When the first edge 507 and the second edge 508 are attached or affixed, a body structure may be created including a wall that defines the flat piece of material. Further, when the first edge 507 and the second edge 508 are attached or affixed, an interior space 535 may be created that extends through the body structure of the extender.

Each of the plurality of folds 501, 502, 503, and 504 may comprise a dynamic portion of the extender that is configured to be manipulated to create a first fold portion A and a second portion B that inwardly extends inwards towards the interior space 535. The body structure of the extender 500 may be configured to be inserted into a garbage can or other waste receptacle. When the body structure of the extender 500 is inserted further into a garbage can or other waste receptacle, each fold 501, 502, 503, and 504 and or dynamic portions may facilitate a change in shape of the wall of the extender so that at least a portion of the wall becomes more tapered. The extender 500 may be made of cardboard, corrugated cardboard, plastic, corrugated plastic, or any material. The extender 500 may be made of recycled materials. The extender 500 may be made out of a disposable material. In some embodiments, the extender 500 may be made of a material that can be reused without significant risk of damage if exposed to environmental elements. In further embodiments, the extender 500 may be made out a metal, such as aluminum, or plastic and can be recycled with the other contents within a receptacle, such as known recyclable items that are commonly discarded.

Each of the plurality of folds 501, 502, 503, and 504 is shown extending from the top edge 505 to the bottom edge 506, and each of the folds 501, 502, 503, and 504 protrudes inward towards the interior space 535. Each of the plurality of folds 501, 502, 503, and 504 protrudes furthest inward towards the interior space 535 proximate to the bottom edge 506. For example, the inward protruding distance of folds 501, 502, 503, 504 may gradually increase towards the bottom edge 506. In other words, the distance inward that each of the plurality of folds 501, 502, 503, and 504 protrude increases along a height H1 of the extender 500 from the top edge 505 to the bottom edge 506. There may be a plurality of folds, such as folds 501, 502, 503, 504, or there may be a single fold. There may be no fold, depending on the size of the garbage can or other waste receptacle into which the extender 500 may be inserted. Extender 500 may be insertable into a garbage can, or other waste or recycling receptacle, for example, in the manner as shown with respect to extenders 100, 200 in FIGS. 1 and 2.

Figure 21:
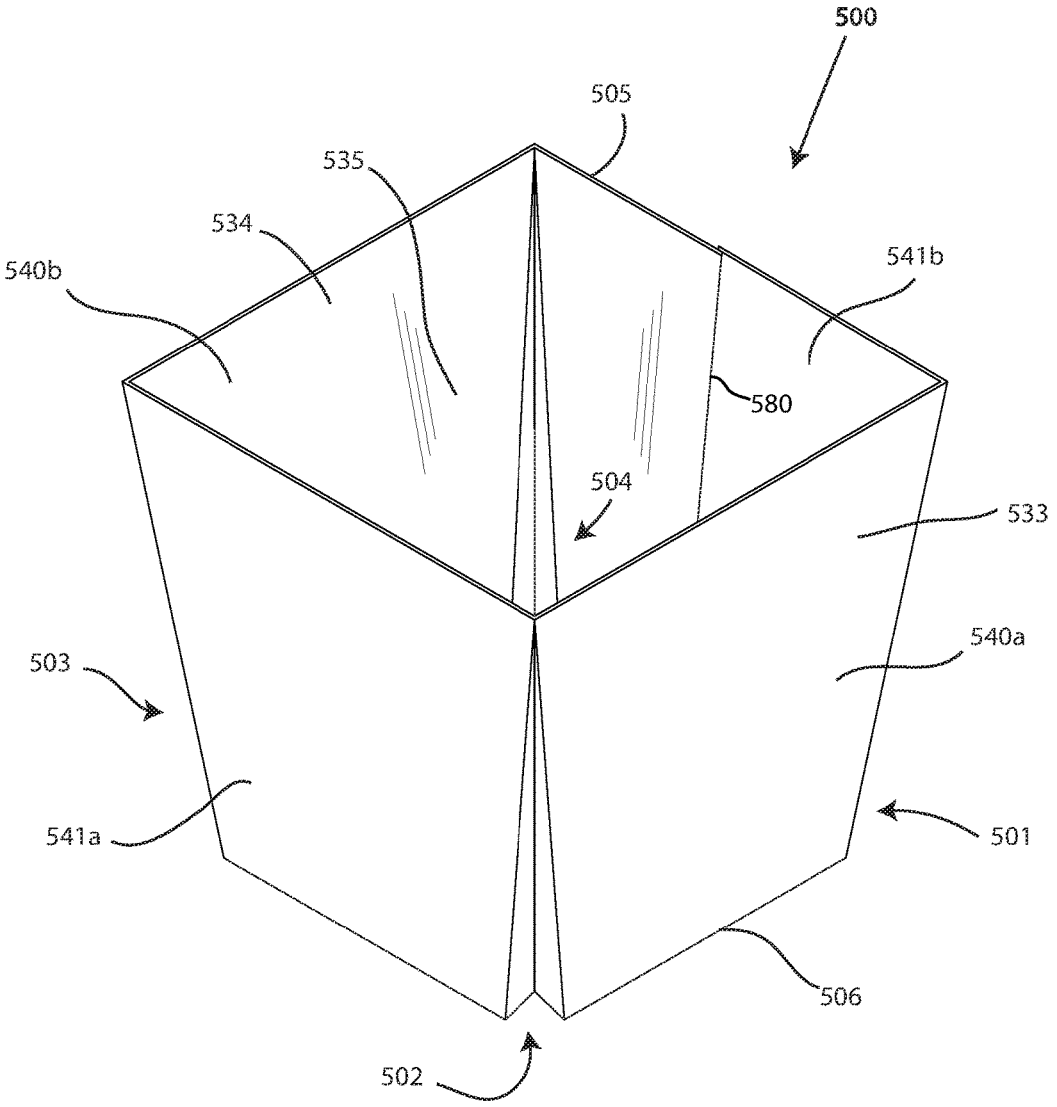
FIG. 21 depicts a perspective view of a fifth embodiment of an extender having a tapered configuration.
Figure 22:
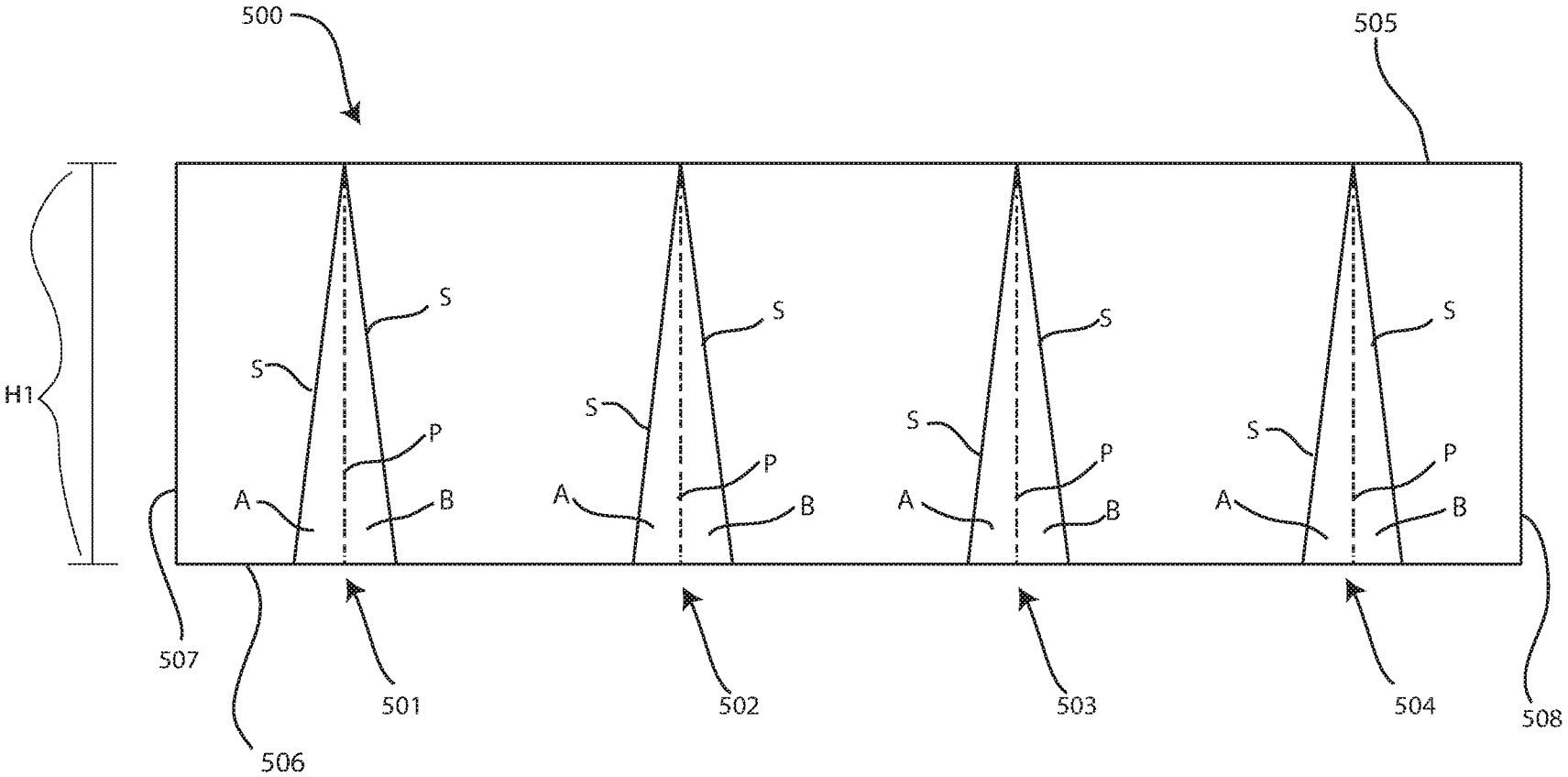
FIG. 22 depicts a pre-assembly view of the fifth embodiment of an extender of FIG. 21.

With continued reference to FIG. 21, referring now to FIG. 22, the extender 500 is shown in a pre-assembly state. Extender 500 may be made of a flat piece of material having a height H1, a first side edge 507 and a second side edge 508. The flat piece of material may have squared edges. In this pre-assembly state, each of the plurality of folds 501, 502, 503, and 504 may be pre-formed by creating a guideline in the extender 500 material in a vertical line P perpendicular to and extending between the top edge 505 and bottom edge 506. The guide line P may be created for example by perforating, creasing, folding the extender 500 material, or the like. On either side of each guide line P may be a scored line S along which the flat piece of material may be scored. Each scored line S extends from the top edge 505 to the bottom edge 506 at an angle to form a triangle shape, the vertical center of which is traversed by a perforated line P. Accordingly, to either side of each perforated line P is a fold portion A, B that has a triangle shape. Fold portions A, B are not limited to being triangular in shape and may be rectangular or substantially rectangular in shape, or may be another shape.

The guide lines P and scored lines S may increase the ease with which the folds 501, 502, 503, and 504 can be pressed inward toward the interior space 535 of the extender. When the folds 501, 502, 503, and 504 are pressed inward toward the interior space 535, an angle between the fold portions A, B may decrease. It should be understood that the folds 501, 502, 503, and 504 are not limited to being pre-formed in this manner, for example, the folds may be entirely pre-formed with perforations, or entirely pre-formed by scoring the extender 500 material. The folds may not be physically pre-formed, and instead, guide lines may be drawn onto the extender 500 material to indicate to a user where the material of the extender should be bent and folded to create the folds 501, 502, 503, and 504.

To assemble extender 500, the first side edge 507 and the second side edge 508 may be brought together to overlap a distance sufficient to permit the first and side edges 507, and 508 to be affixed to one another at seam 580. The first side edge 507 and the second side edge 508 may be glued together without overlapping, and instead meeting edge to edge. The first side edge 507 and the second side edge 508 can be affixed with glue or other suitable adhesive. The first side edge 507 and the second side edge 508 may be affixed by a single tab or plurality of tabs. For example, first side edge 507 may have a tab or a plurality of tabs extending therefrom which are configured to engage with a corresponding slit, hole, bore, or opening or plurality thereof formed in second side edge 508. As another example, first side edge 507 and second side edge 508 may be configured to affix to one another by Velcro, magnets, toggles, buttons, zippers, hooks, staples, stitches, and the like.

The extender 500 may be assembled to have four sides 540*a*, 540*b*, 541*a*, and 541*b* as shown in FIG. 21 by bending the extender 500 material at each of the plurality of folds 501, 502, 503, and 504. A taper can be formed in the extender 500 by pressing each of the plurality of folds 501, 502, 503, and 504 inward towards the interior space 535 of the extender 500. This may give the extender 500 the ability to function with differently sized garbage cans and waste receptacles.

Figure 23:
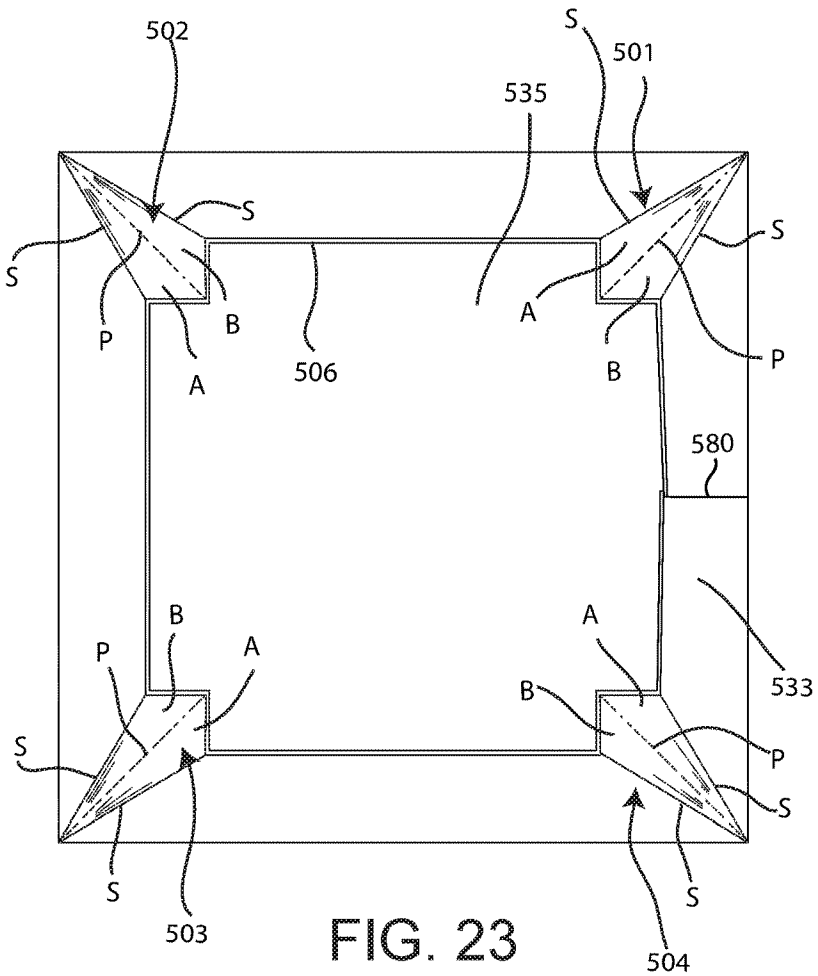
FIG. 23 depicts a bottom view of the fifth embodiment of an extender of FIG. 21.

Referring to FIG. 23, a bottom view of extender 500 in which each of the plurality of folds 501, 502, 503, and 504 have been pressed inward toward the interior space 535 of the extender 500 is shown. Each A face may thereby be pressed toward the B face next to it. When the folds 501, 502, 503, and 504 are pressed inward in this manner, the guide lines P of each fold 501, 502, 503, and 504 may extend the farthest distance inward toward the interior space 535, and each pair of scored lines S may move closer together. The bottom edge 506 of extender 500 is thereby configured into an opening that is narrow and can be placed into an opening of a trash receptacle, wherein the top edge 505 forms an opening into which trash material 15 may be received that is larger than the narrow opening formed by the bottom edge.

Figure 24:
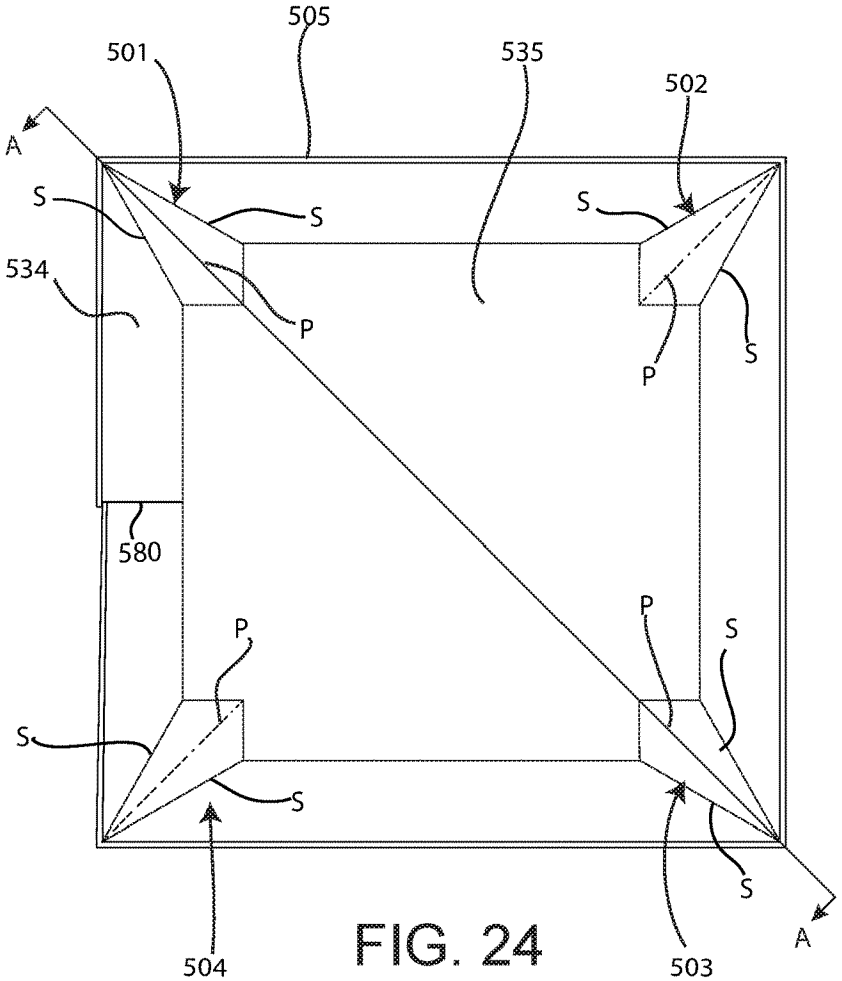
FIG. 24 depicts a top view of the fifth embodiment of an extender of FIG. 21.
Figure 25:
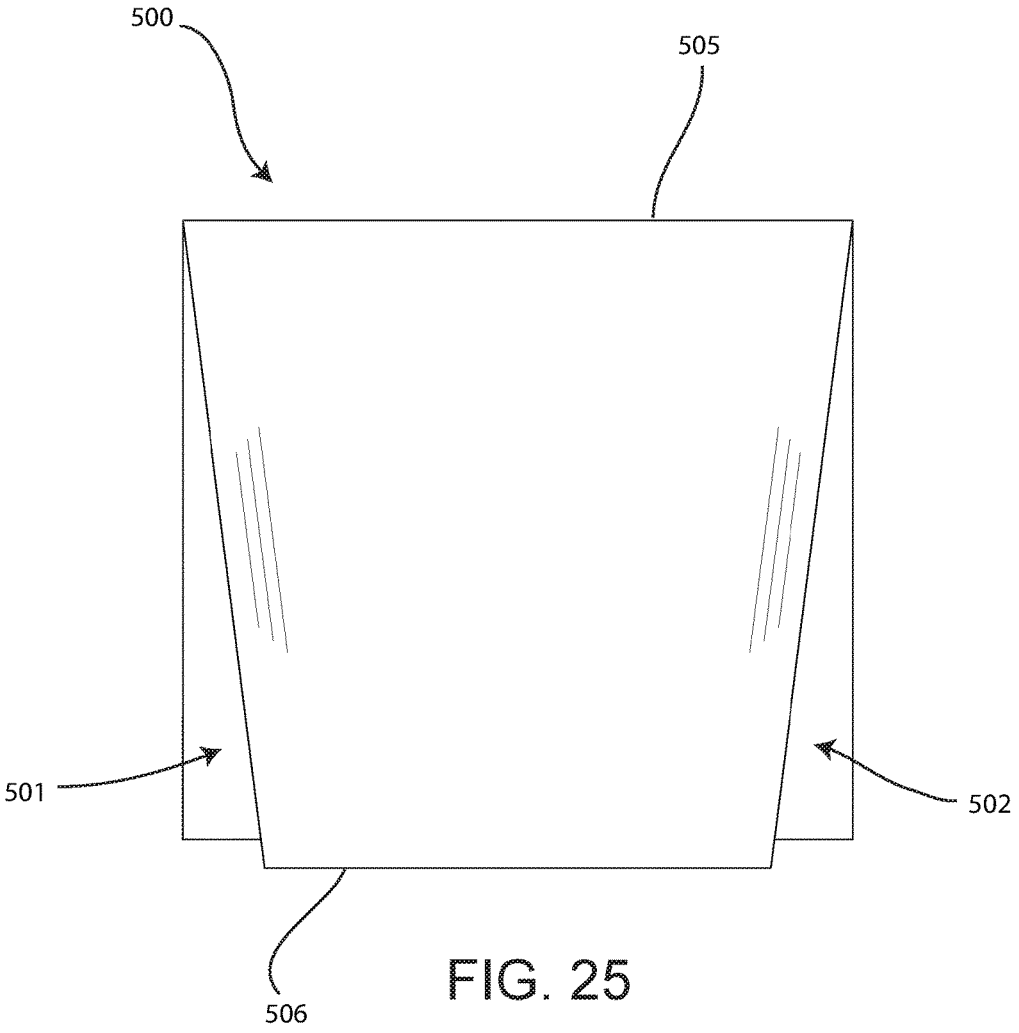
FIG. 25 depicts a side view of the fifth embodiment of an extender of FIG. 21.
Figure 26:
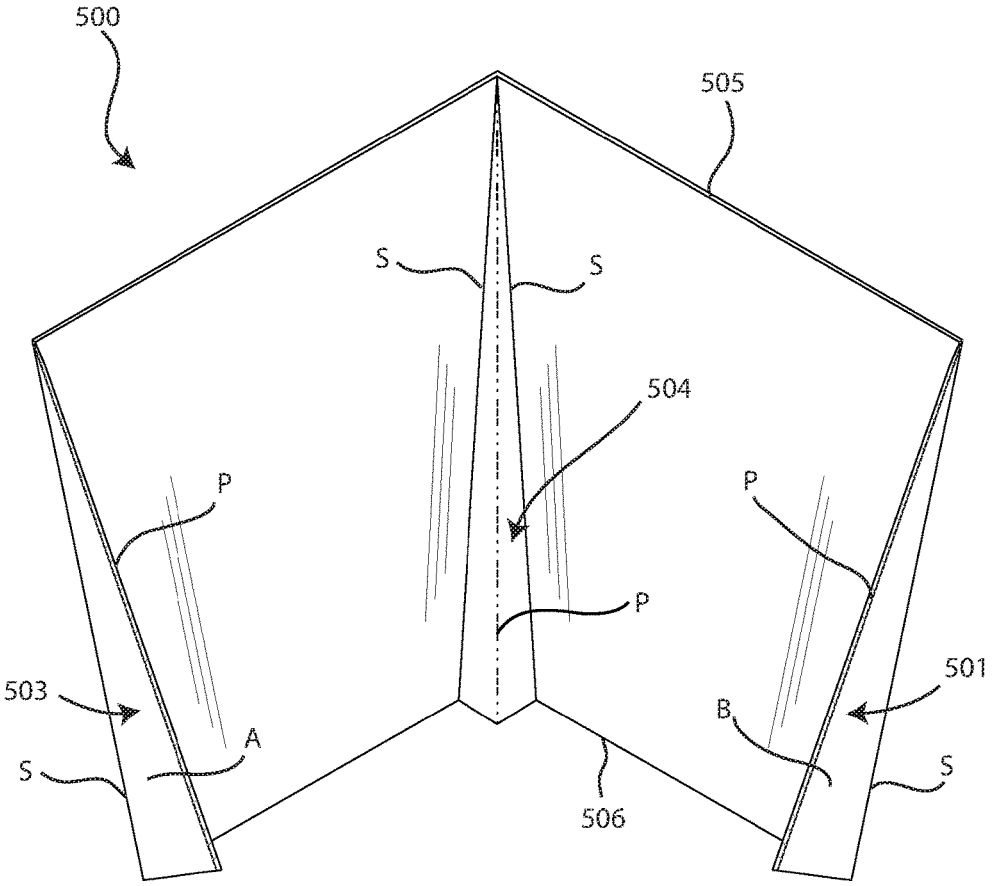
FIG. 26 depicts a cross section view of the fifth embodiment of an extender of FIG. 21 taken along line A-A.

Referring to FIG. 24, a top view of extender 500 is shown. Each of the plurality of folds 501, 502, 503, and 504 may extend inwards toward the interior 535. FIG. 25 shows a side view of extender 500 in which folds 501 and 502 are visible, each of which may be pressed inward toward the interior 535, thereby giving extender 500 a tapered shape. Referring to FIG. 26, a cross section view of extender 500 is shown taken along line A-A. Fold portion A of fold 502 and fold portion B of fold 504 are shown in this view extending inward toward the interior space 535 of the extender 500. It should be understood that the folds 501, 502, 503, and 504 may bend toward the inner surface 534 of the extender as waste materials are placed into the extender 500, for example, the folds 501, 502, 503, and 504 may flexibly extend into the interior space 535.

The folds 501, 502, 503, and 504 that form the taper of the extender 500 may permit the extender 500 to expand and contract, for example, the angle between the fold portions A, B may reduce as a user presses the extender 500 further into a garbage can or other waste receptacle, which may facilitate a change in shape of the extender 500, or a wall thereof. For example, the shape of the extender 500 or a wall thereof may become more tapered. This may be advantageous in engaging differently sized garbage cans or waste or recycling receptacles with a secure friction fit. For example, a user may have one size waste receptacle and a different sized recycling receptacle. The folds 501, 502, 503, and 504 may permit the extender 500 to be placed in differently sized receptacles such that the user may only need to purchase one size extender 500 to fit both the waste receptacle and the recycling receptacle. As an example, in the instance of a smaller receptacle, a user may press in the folds 501, 502, 503, and 504 more than if the user was placing the extender in a larger receptacle. In the case of a larger receptacle, the folds may not need to be pressed in. As another example, a garbage can or other waste receptacle may have a tapered shape such that an opening of the garbage can or waste receptacle may be larger at the top and become smaller as the opening extends to a bottom of the garbage can or other waste receptacle. The folds 501, 502, 503, and 504 of an extender 500 may permit the extender 500 to conform to the tapered shape of the garbage can or receptacle. For example, as the user presses the extender 500 further into the garbage can or receptacle, the angle between fold portion A and fold portion B may reduce such that the extender 500 or a wall thereof changes shape to become more tapered, for example, to match the taper of the garbage or receptacle.

The folds 501, 502, 503, and 504 may also improve the fit of the extender 500 in a receptacle by creating friction between the extender 500 and the receptacle. As more waste materials 15 are placed in extender 500, more force may push outward against the inner surface 534 of the extender 500, which may add to the friction fit of the extender 500 in the waste or recycling receptacle.

The tapered shape of the extender 500 may also permit multiple extenders 500 to be stacked inside one another in the instance that waste materials 15 need to be directed into a trash or recycling receptacle from a distance, as is often the case when construction or demolition is taking place on a second or higher floor of a building. For example, a waste receptacle may be placed below a window, and multiple extenders 500 may be stacked inside one another until a top edge 505 of an extender reaches the window. A user can then direct waste materials 15 through the stack of extenders 500 into the waste receptacle below. The extender 500 may have a plurality of slots, holes, tabs, or the like that are configured to engage with a plurality of folds 501, 502, 503, and 504 of another extender 500 such that when multiple extenders 500 are stacked inside one another, the folds thereof engage with the extender 500 the folds are being inserted into, such that the folds may be prevented from inserting further into the extender 500. For example, the folds of a first extender 500 may be pressed inward as the first extender 500 is inserted into a second extender 500, and as the folds meet slots in the second extender 500, a portion of the folds may extend through the slots thereby preventing the first extender 500 from being inserted further into the second extender. This may increase the structural integrity of a stack of multiple extenders 500.

Figure 27:
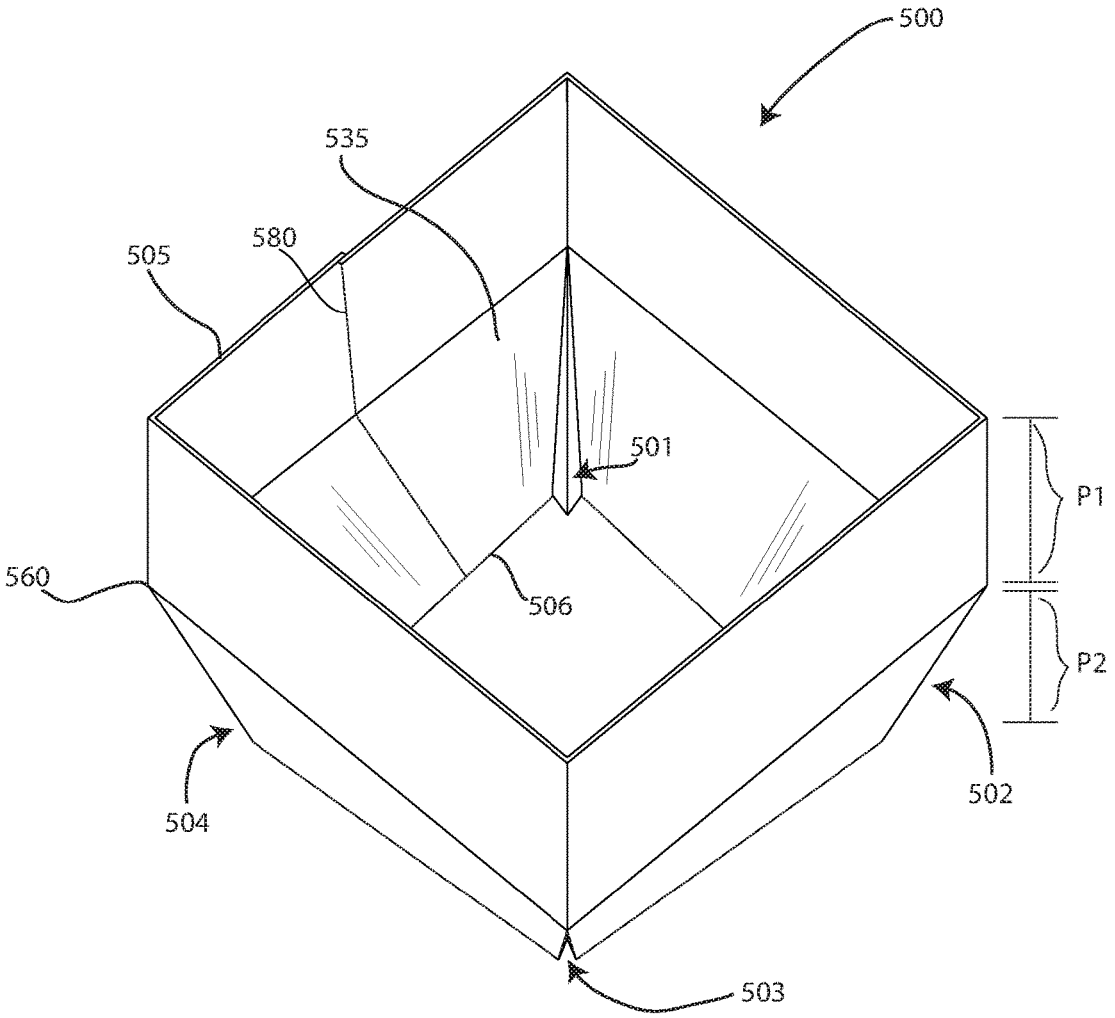
FIG. 27 depicts a perspective view of the fifth embodiment of an extender having a partly tapered configuration.

It should be understood that the extender 500 is not limited to having a tapered shape extending from the top edge 505 and continuing to the bottom edge 506. For example, referring now to FIG. 27, an embodiment of extender 500 is shown in which extender 500 has a first portion P1 which is not tapered, and a second portion P2 which is tapered. In this embodiment, the plurality of folds 501, 502, 503, and 504 may extend from a point 560 between the top edge 505 and the bottom edge 506 of the extender 500 to the bottom edge 506 of the extender 500, and each of the plurality of folds 501, 502, 503, and 504 may extend from the point 560 to the bottom edge 506

Figure 28:
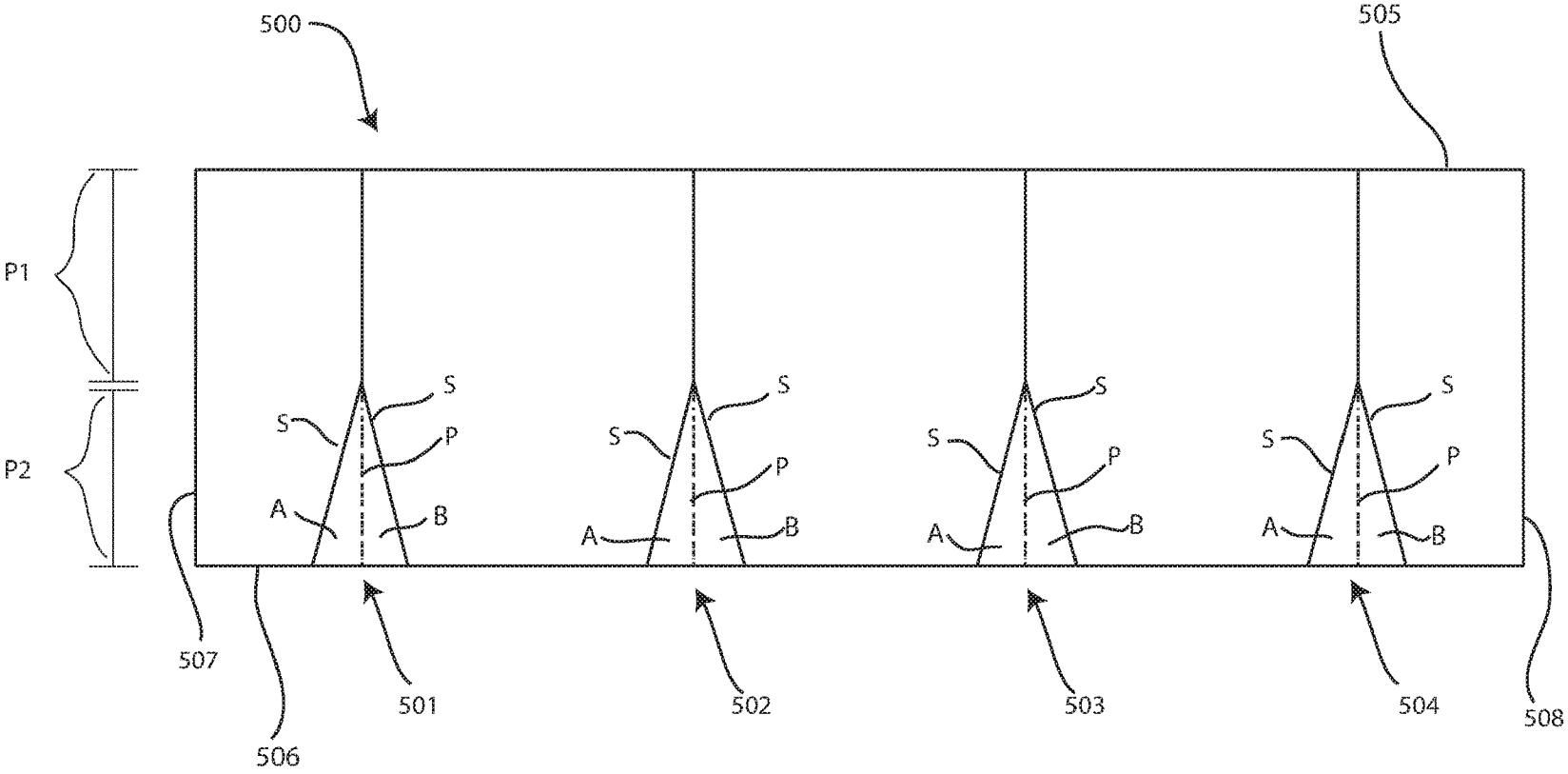
FIG. 28 depicts a pre-assembly view of the fifth embodiment of an extender of FIG. 27.
Figure 29:
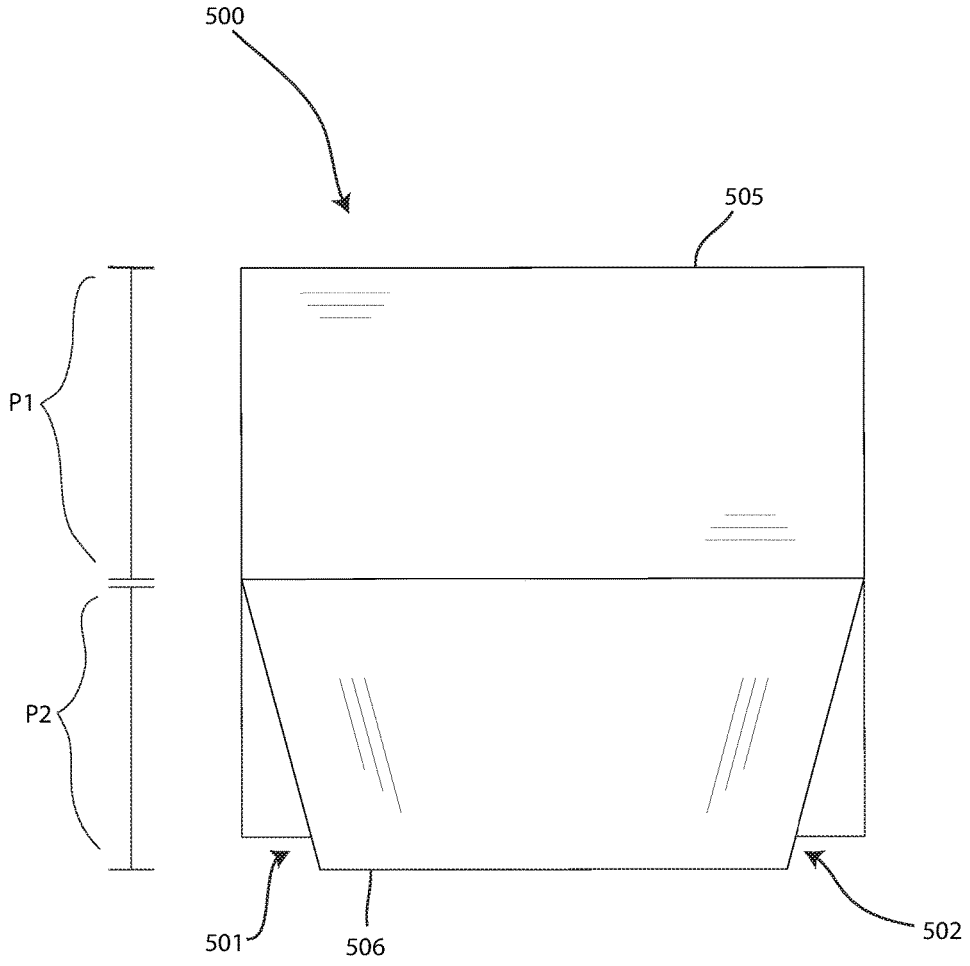
FIG. 29 depicts a side view of the fifth embodiment of an extender of FIG. 27.

FIG. 28 shows the first portion P1 and the second portion P2 of the extender 500 having this embodiment in its pre-assembly form. To assemble the extender in this embodiment, the first edge 507 and the second edge 508 may be brought together and affixed. The first portion P1 may be formed by bending the first portion to have a corner above each of the plurality of folds 501, 502, 503, and 504. This may be facilitated by scoring a line beginning from the point 560 above each guide line P and extending to the top edge 505. As shown in the side view of FIG. 29, the folds 501, 502, 503 (not shown) and 504 (not shown) may be pressed inwards towards the interior space 535 (not shown) to create a taper in the second portion P2.

Figure 30:
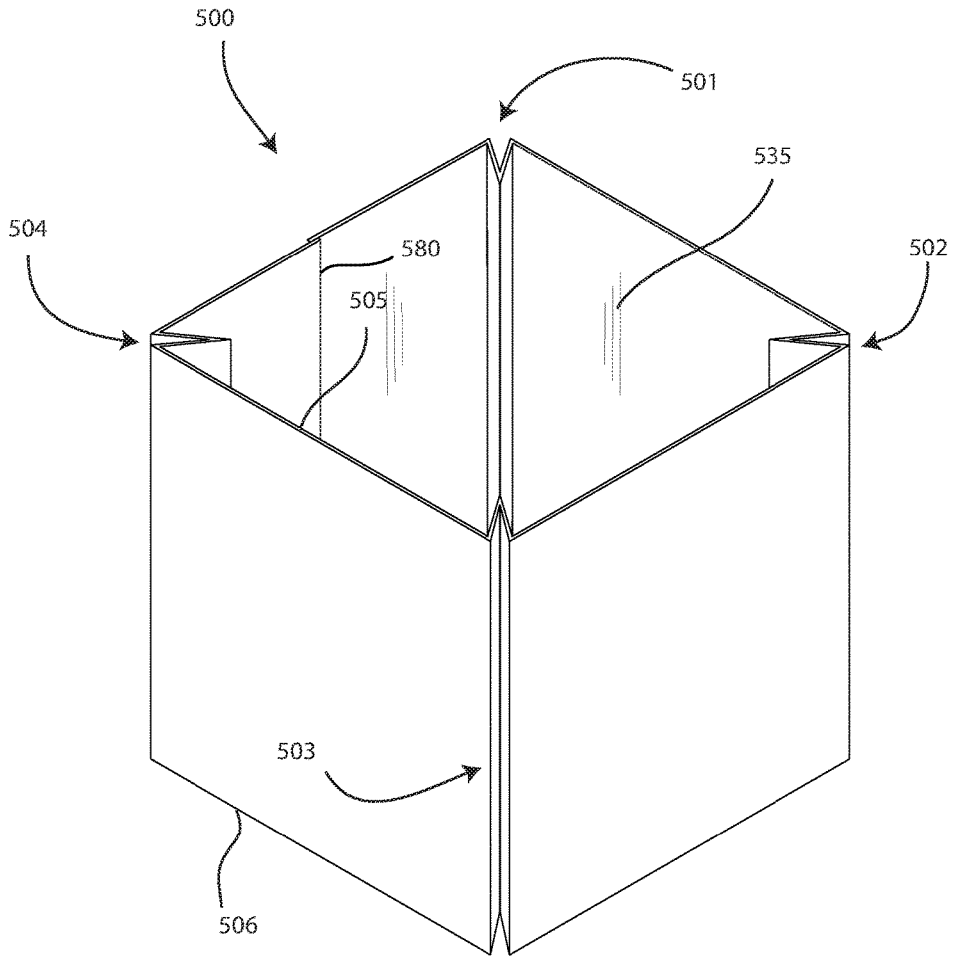
FIG. 30 depicts a perspective view of the fifth embodiment of an extender having no taper.
Figure 33:
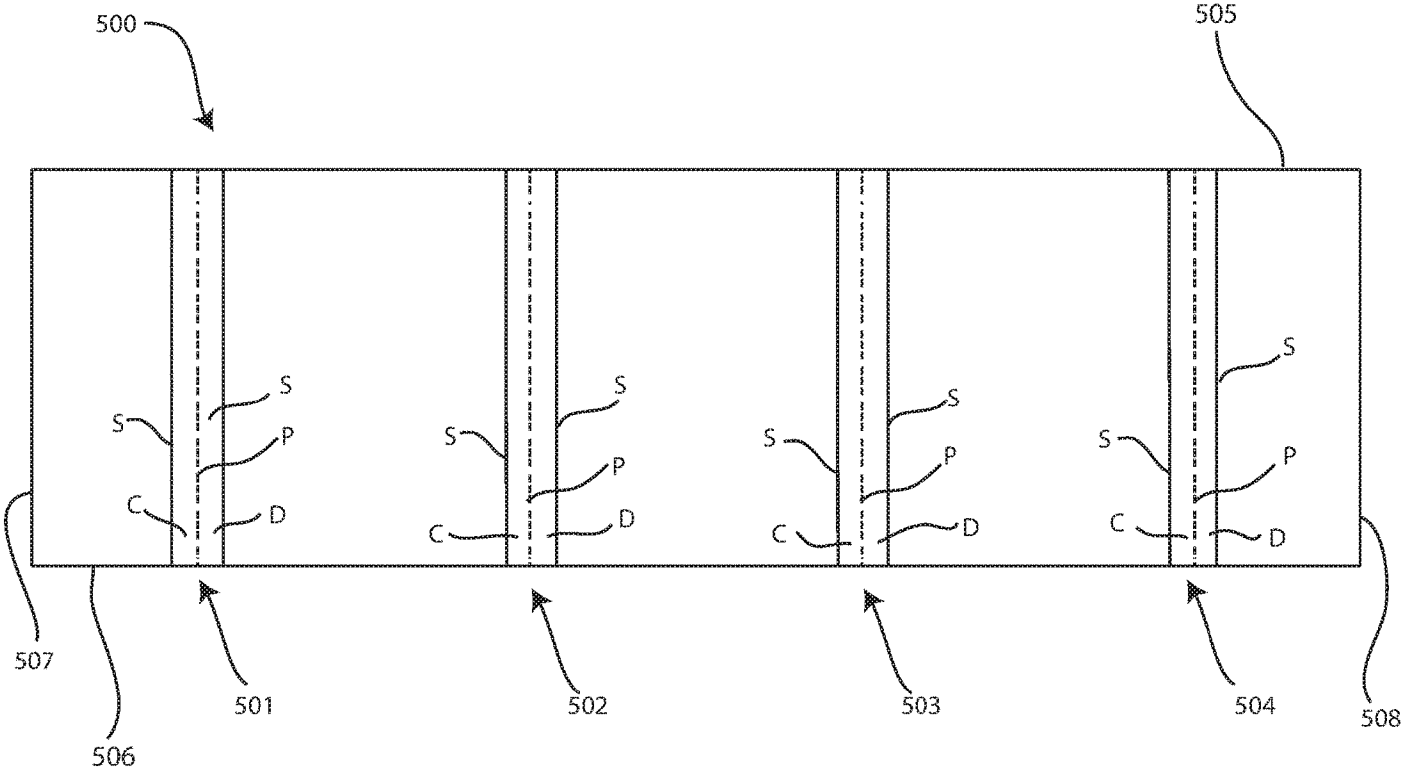
FIG. 33 is a pre-assembly view of the fifth embodiment of an extender of FIG. 30.

As another example, extender 500 may have no taper, as shown in FIG. 30, wherein each of the plurality of folds 501, 502, 503, and 504 extend inwards towards the interior space an equal distance from the top edge 505 to the bottom edge 506. With continued reference to FIG. 30, referring now to FIG. 33, a pre-assembly view of this embodiment is shown; each of the plurality of folds 501, 502, 503, and 504 may be pre-formed by a guide line P extending perpendicular from the top edge 505 to the bottom edge 506, and two scored lines S an equal distance from the guide line and extending perpendicular from the top edge 505 to the bottom edge 506. The scored lines S create a fold portion C, D on either side of each guide line P. First edge 507 and second edge 508 may be brought together and affixed at seam 580, and each fold 501, 502, 503, and 504 may be pressed inwards towards the interior space 535.

Figure 32:
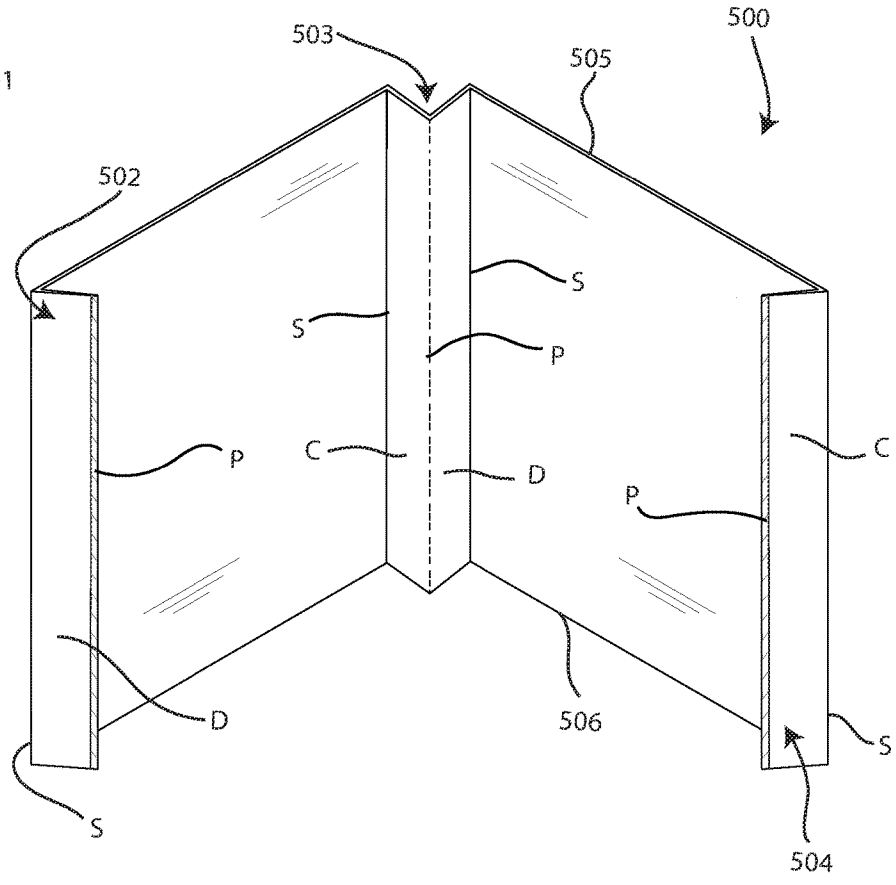
FIG. 32 is a cross section view of the fifth embodiment of an extender of FIG. 30 taken along line D-D.
Figure 31:
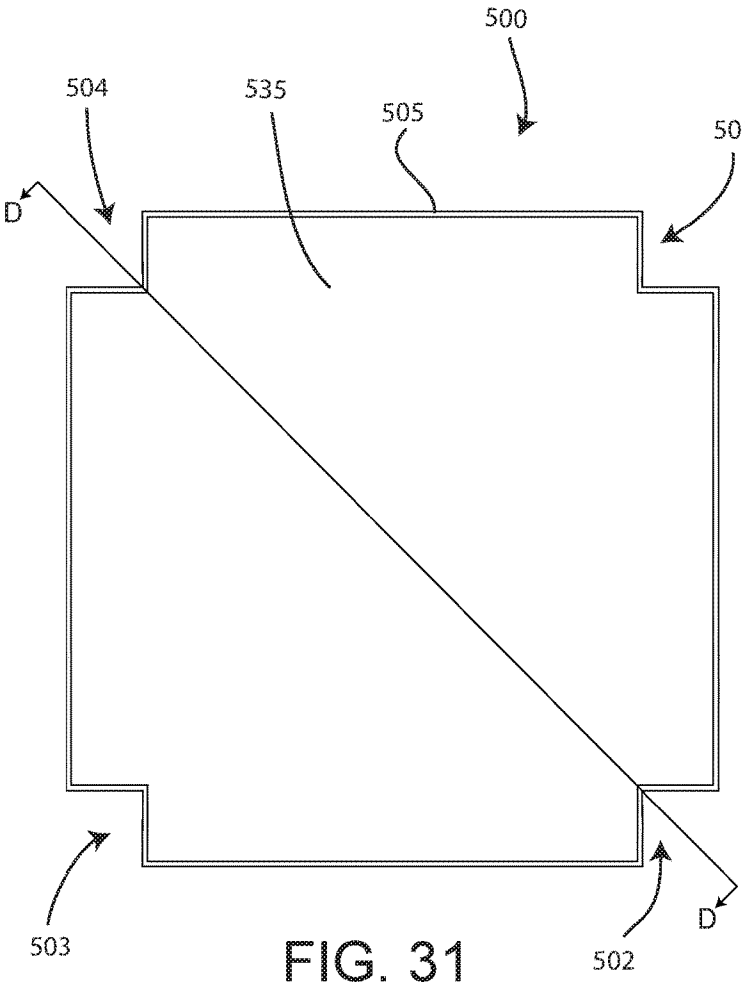
FIG. 31 is a top view of the fifth embodiment of an extender of FIG. 30.

Referring to FIG. 31, a top view of the extender 500 having a straight shape is shown. Each of folds 501, 502, 503, and 504 extend inwards toward the interior 535 of the extender 500. FIG. 32 shows a cross section view taken along line D-D. Fold portion C of fold 504 and face D of fold 502 are visible in the cross section. As shown, fold portion C and fold portion D are rectangular in shape and extend the same distance inward towards the interior 535 from the top edge 505 to the bottom edge 506, such that extender 500 in this embodiment has no taper. As a user inserts the extender 500 further into a garbage can or other waste receptacle, the angle between the fold portion C and fold portion D may reduce, which may facilitate a change in the shape of the extender 500, or a wall of the extender.

In this embodiment wherein extender 500 has no taper, as more waste materials 15 are placed into the extender 500, the more force will press outward against the inner surface 534 of the extender 500, which may create a tapered shape in the extender 500 as the portion of the extender 500 extending outside a waste receptacle expands outward in all directions parallel to the top edge 505.

Figure 34:
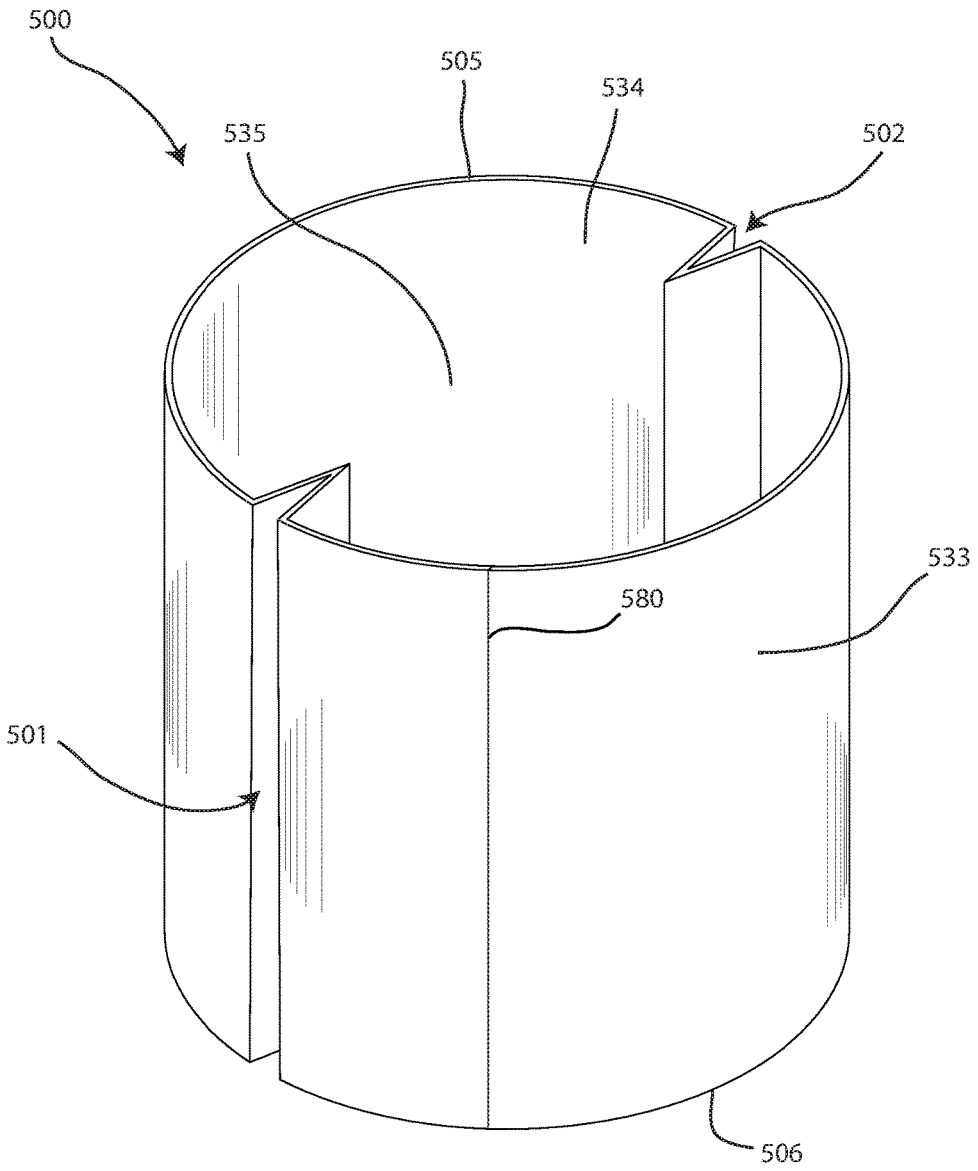
FIG. 34 is a perspective view of the fifth embodiment of an extender having a cylindrical shape.

As yet another example, extender 500 may have a cylindrical shape, as shown in FIG. 34. Extender 500 may have one or more folds 501, and 502 extending inward toward the interior space 535 across from one another, though extender 500 could have any number of folds, for example, extender 500 could be cylindrical in shape and have three, four, or more folds. Extender 500 may have a cylindrical shape and have a fold or plurality of folds configured to taper the extender 500. Further, extender 500 may have a cylindrical shape, and have a single or plurality of folds that when pressed inward toward the interior space 535 facilitate a change in shape of the extender 500 to be more tapered. As another example, the extender may be cylindrical and have a first portion that is not tapered and a second portion that is tapered. In that instance, the cylindrical extender 500 may have a single or plurality of folds extending from a midpoint between the top edge 505 and the bottom edge 506 to the bottom edge.

Extender 500 is not limited to have a rectangle or circular shape, and could have any shaped cross section to facilitate usage with any shaped trash receptacle. For example, extender 500 could have an oval, triangle, hexagon, octagon, or other shape. Further, extender 500 is not limited to having two or four folds, and could have any number of folds.

A method for making extender 500 may comprise providing a flat piece of material having a first edge 507 and a second edge 508, a top edge 505 and a bottom edge 506, wherein the first edge 507 and second edge 508 are perpendicular to the top edge 505 and the bottom edge 506. The method may further comprise pre-forming a single fold, or a plurality of folds by creating a guide line in between the top edge 505 and the bottom edge 506. The method may comprise preforming a single or plurality of dynamic portions in the flat piece of material. The method may further comprise affixing the first edge 507 to the second edge 508. Pre-forming the single fold or plurality of folds may further comprise scoring a line extending between the top edge 505 and the bottom edge 506 on either side of each perforated line. The method may not include affixing first edge 507, and second edge 508, for example, where first edge 507 and second edge 508 are configured to attach by Velcro, magnets, toggles, buttons, zippers, hooks, and the like. In that instance, the method may further comprise attaching Velcro, magnets, toggles, buttons, zippers, hooks, staples, stitches, or the like to the first edge 507 or the second edge 508, and configuring the opposite edge to securably or removably engage with the Velcro, magnets, toggles, buttons, zippers, hooks, or the like.

After use, when a user's waste or recycling cans are picked up by for example, a waste collecting truck, the extender 500 can simply be dumped out of a waste or recycling bin with the rest of the waste or recycling therein. Before use, extender 500 may be stored flat by unfolding the plurality of folds 501, 502, 503, and 504 and pressing extender 500 flat. The extender 500 may further be folded in half to decrease the amount of space the extender 500 takes up. For example, if a user has multiple extenders 500 that they use for waste material and recycling, the user may flatten the extenders to be stored out of the way. Further in this regard, the extender 500 may be manufactured in bulk quantities, with the first edge 507 and the second edge 508 affixed, and the extender 500 pressed flat. The extender 500 may then be shipped transported to a seller in large quantities, and the extender 500 may be sold in a flat shape that does not take up a large amount of space and that is accordingly easy to transport. Further, if the extender 500 does not come out of the waste or recycling bin when the waste or recycling is collected, the functionality of the extender 500 to be able to flatten may also facilitate easier disposability for single use extenders 500. When a user completes a single use of the extender 500 the extender 500 can be flattened and slid into a waste or recycle bin to be taken away.

Extender 500 can be widely used within municipalities and neighborhoods to provide a uniform way for users to get rid of additional waste and recycling. Residents, users, or customers may purchase one or more extenders 500 when they need to have additional waste or recycling taken away, for example, at a single source point such as a Town or City Hall, or at a supply location. A resident, user or customer may then place an extender 500 in their trash bin or recycle bin and any amount of waste that can fit in the extender 500 may also be taken away when the resident, user, or customer's trash and recycling is picked up. Rather than have additional bags of waste on the user's lawn or driveway to which purchased stickers or tags must be applied, no extra time, or physical work must be applied by garbage and waste collectors to take away the extra waste or recycling; the additional waste or recycling may be dumped into the garbage truck with the waste or recycling in the waste or recycling bin. This may reduce the need for personnel additional to the driver of a waste or recycling truck or vehicle.

A method for collecting waste may comprise providing an extender formed from at least one flat piece of material that has straight edges comprising a body structure. The body structure may be formed by attaching a first edge of the at least one flat piece of material to a second, opposing edge of the flat piece of material. The body structure may include a wall defining an interior space extending through the body structure. The extender may include at least one dynamic portion of the body structure configured to be manipulated to create a first fold portion and a second fold portion that inwardly extends into the interior space. The extender may be configured to receive waste materials through the interior space. The method may comprise inserting the extender into a waste receptacle. The method may further comprise dumping the waste receptacle out such that the extender, any contents in the extender, and any contents held in the waste receptacle are transferred to a separate container. The dumping may be performed by a garbage collector using a collection vehicle such as a garbage truck 1000 as shown in FIGS. 7, 8. The dumping step of the method may comprise securing, grabbing, or otherwise manipulating the waste receptacle to invert at least to some degree such that the contents of the waste receptacle, including the extender 500 may exit an interior of the waste receptacle into a collection area of the collection vehicle. While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. An extender, the extender formed from at least one flat piece of material, wherein the at least one flat piece of material is rectangular in shape and has straight edges and is defined by a first edge, a second edge opposing the first edge, a top edge, and a bottom edge, the extender comprising:

a body structure, the body structure formed by attaching the first edge to the second edge, wherein the body structure includes a wall defined by the top edge and the bottom edge, wherein the wall defines an interior space extending through the body structure;

a first opening defined by the bottom edge and a second opening defined by the top edge, wherein the interior space is further defined by the first opening and the second opening, wherein the interior space is configured to hold waste materials along the bottom edge to the top edge;

a first fold portion defined by a first fold line extending from the top edge to the bottom edge, a second fold line extending from the top edge to the bottom edge, and a first portion of the bottom edge extending from the first fold line to the second fold line;

a second fold portion defined by the first fold line, and a third fold line extending from the top edge to the bottom edge, and a second portion of the bottom edge extending from the first fold line to the third fold line;

wherein the first fold portion and second fold portion are configured to be pressed together such that a tapered section is formed in the body structure and such that an area of the first opening at the bottom edge is less than an area of the second opening at the top edge;

wherein the body structure is configured to be inserted into a garbage can to extend a capacity of the garbage can, and as the body structure is further inserted into the garbage can, the first fold portion and second fold portion are pressed closer together and facilitate a change in shape of the wall so that at least a portion of the wall becomes more tapered the further the body structure is inserted into the garbage can.

2. The extender of claim 1, wherein an angle between the first fold portion and the second fold portion is reduced when the body structure is further inserted into the garbage can to facilitate the change in shape of the wall during further insertion of the body structure into the garbage can.

3. The extender of claim 1, wherein the wall includes an upper portion and a lower portion, and the portion of the wall that becomes more tapered is the lower portion of the wall while the upper portion remains straight.

4. The extender of claim 1 wherein the body structure is circular in shape.

5. The extender of claim 1, wherein the body structure has a rectangular shape.

6. The extender of claim 1 wherein the first fold line, second fold line, and third fold line are each guide lines preformed in at least one flat piece of material.

7. The extender of claim 1, wherein the bottom edge is configured to be placed into a receptacle.

8. The extender of claim 1, wherein the extender comprises additional fold portions at each corner of the wall of the body structure adjacent to the first opening.

9. An extender comprising:

at least one piece of material, wherein the at least one piece of material is rectangular in shape and is defined by a first edge, a second edge opposing the first edge, a top edge, and a bottom edge;

wherein the first edge and the second edge are attached to create an interior space extending through the extender from the top edge to the bottom edge, wherein the bottom edge defines a first opening of the extender and the top edge defines a second opening of the extender, wherein the interior space is configured to hold waste materials along the bottom edge to the top edge;

a point located between the top edge and the bottom edge;

an upper portion of the extender extending between the top edge and the point; and a lower portion of the extender extending between the point and the bottom edge;

wherein the lower portion comprises a first fold portion defined by a first fold line extending from the point to the bottom edge, a second fold line extending from the point to the bottom edge, and a first portion of the bottom edge extending from the first fold line to the second fold line; and a second fold portion defined by the first fold line, and a third fold line extending from the point to the bottom edge, and a second portion of the bottom edge extending from the first fold line to the third fold line;

wherein the first fold portion and second fold portion are configured to be pressed together such that a tapered section is formed in the lower portion and such that an area of the first opening at the bottom edge is less than an area of the interior space at the point;

wherein an area of the second opening at the top edge is equal to the area of the interior space at the point as the first fold portion and second portion are pressed together such that the upper portion is not tapered.

10. The extender of claim 9 wherein the first fold portion has a first area and the second fold portion has a second area wherein the first area and second area are the same.

11. The extender of claim 9, wherein the extender has a rectangular shape.

12. The extender of claim 9, wherein the extender has a circular shape.

13. The extender of claim 9, wherein the extender comprises a first wall, a second wall, a third wall, and a fourth wall;

wherein the first fold portion and second fold portion, and additional folds are located at each corner of the extender.

14. The extender of claim 9, wherein an angle between the first fold portion and the second fold portion is reduced when the body structure is further inserted into the garbage can to facilitate the change in shape of the wall during further insertion of the body structure into the garbage can.

15. A method for manufacturing an extender, the method comprising:

pre-forming at least one dynamic portion in at least one flat piece of material, wherein the at least one flat piece of material is rectangular in shape and is defined by a first edge, a second edge opposing the first edge, a top edge, and a bottom edge, wherein the at least one flat piece of material comprises an upper portion and a lower portion, wherein the pre-forming comprises creating within the lower portion, a vertical guide line, a second guide line, and a third guideline, wherein a first fold portion is defined by the vertical guideline, the second guide lines, and a first portion of the bottom edge extending between the vertical guideline and the second guideline, wherein a second fold portion is defined by the vertical guideline, the third guideline, and a second portion of the bottom edge extending between the vertical guideline and the third guideline wherein the first edge and second edge are configured to be joined to form a body structure configured to hold waste materials along the bottom edge to the top edge, wherein the first fold portion and second fold portion are configured to be pressed together such that a tapered section is formed in the body structure and such that an area of the first opening at the bottom edge is less than an area of the second opening at the top edge.

16. The method of claim 15 further comprising scoring the second guideline, and scoring the third guideline.

17. A method for collecting waste, the method comprising:

providing a receptacle for storing waste materials, the receptacle configured to be lifted and inverted by a mechanical means of a garbage collection vehicle to empty the waste materials;

providing an extender for use with the receptacle, the extender cooperating with the receptacle to increase a storage capacity of the provided receptacle, wherein the extender is disposable along with the waste materials; and at the same time, collecting the waste materials and the extender using the mechanical means of the garbage collection means;

wherein the extender is formed from at least one flat piece of material, wherein the at least one flat piece of material is rectangular in shape and has straight edges and is defined by a first edge, a second edge opposing the first edge, a top edge, and a bottom edge and wherein the extender comprises:

a body structure, the body structure formed by attaching the first edge to the second edge, wherein the body structure includes a wall defined by the top edge and the bottom edge, wherein the wall defines an interior space extending through the body structure;

a first opening defined by the bottom edge and a second opening defined by the top edge, wherein the interior space is further defined by the first opening and the second opening, wherein the interior space is configured to hold waste materials along the bottom edge to the top edge;

a first fold portion defined by a first fold line extending from the top edge to the bottom edge, a second fold line extending from the top edge to the bottom edge, and a first portion of the bottom edge extending from the first fold line to the second fold line; and a second fold portion defined by the first fold line, and a third fold line extending from the top edge to the bottom edge, and a second portion of the bottom edge extending from the first fold line to the third fold line;

wherein the first fold portion and second fold portion are configured to be pressed together such that a tapered section is formed in the body structure and such that an area of the first opening at the bottom edge is less than an area of the second opening at the top edge;

wherein the body structure is configured to be inserted into a garbage can to extend a capacity of the garbage can, and as the body structure is further inserted into the garbage can, the first fold portion and second fold portion are pressed closer together and facilitate a change in shape of the wall so that at least a portion of the wall becomes more tapered the further the body structure is inserted into the garbage can.

* * * * *